US012668932B2

(12) United States Patent
Kruse et al.

(10) Patent No.: US 12,668,932 B2
(45) Date of Patent: Jun. 30, 2026

(54) LASER-CONTROLLED TRUSS SCREED APPARATUS

(71) Applicant: Kelly Kruse, Bozeman, MT (US)

(72) Inventors: Kelly Kruse, Bozeman, MT (US); Steven K. Lundberg, Kalispell, MT (US)

( * ) Notice: Subject to any disclaimer, the term of this patent is extended or adjusted under 35 U.S.C. 154(b) by 491 days.

(21) Appl. No.: 18/370,353

(22) Filed: Sep. 19, 2023

(65) Prior Publication Data

US 2025/0092616 A1 Mar. 20, 2025

(51) Int. Cl.
*E01C 19/40* (2006.01)
*E01C 19/00* (2006.01)

(52) U.S. Cl.
CPC ..... *E01C 19/006* (2013.01); *E01C 19/40* (2013.01)

(58) Field of Classification Search
CPC ..... E01C 19/006; E01C 19/40
USPC ..... 404/84.05–84.5, 120
See application file for complete search history.

(56) References Cited

U.S. PATENT DOCUMENTS 4,465,397 A * 8/1984 Hollon ..... E01C 19/4873 404/72
4,655,633 A * 4/1987 Somero ..... E01C 19/006 404/75
4,708,520 A * 11/1987 Rowe ..... E01C 19/187 404/115
4,822,210 A * 4/1989 Oury ..... E01C 19/407 404/106
5,039,249 A 8/1991 Hansen
5,156,487 A 10/1992 Haid
5,190,396 A 3/1993 Aoyagi et al.
5,567,075 A 10/1996 Allen
5,871,302 A 2/1999 Carlson
6,672,797 B1 1/2004 Zachman et al.
6,830,409 B2 * 12/2004 Carlson ..... E01C 19/405 404/118
7,318,688 B1 * 1/2008 Bavaro ..... E01C 19/40 404/118
7,909,533 B2 3/2011 Quenzi et al.
8,152,409 B1 4/2012 Ligman
2002/0127058 A1 9/2002 Zachman et al.
2007/0116520 A1 * 5/2007 Quenzi ..... E01C 19/405 404/114
2010/0221067 A1 9/2010 Kahle

FOREIGN PATENT DOCUMENTS

CN 112523512 A 3/2021
CN 115467522 A 12/2022
EP 1892332 A1 2/2008
JP 07173925 A 7/1995
(Continued)

*Primary Examiner* — Raymond W Addie
(74) *Attorney, Agent, or Firm* — Antoinette M. Tease

(57) ABSTRACT

A laser-controlled truss screed apparatus with a laser, a mover, a truss assembly, and first and second receivers. The truss assembly includes a screed, a trolley, a truss, legs, and first and second vertical posts. The receivers are configured to receive a signal from the laser. The mover is disposed on a first end of the truss, and the legs are disposed on a second end of the truss. The vertical posts, the trolley, and the screed are configured to form a single unit that travels back and forth along the truss. The legs are configured to raise and lower while maintaining a position of the truss relative to the wheels.

14 Claims, 30 Drawing Sheets

(56) References Cited

FOREIGN PATENT DOCUMENTS

| | | | |
|---|---|---|---|
| JP | 2001152668 | A | 6/2001 |
| JP | 2011153423 | A | 8/2011 |
| JP | 2021070920 | A | 5/2021 |
| WO | WO 2012/034950 | A1 | 3/2012 |

* cited by examiner

LASER-CONTROLLED TRUSS SCREED APPARATUS

BACKGROUND OF THE INVENTION

1. Field of the Invention

The present invention relates generally to the field of concrete installation, and more particularly, to a laser-controlled apparatus for laying screed more safely and efficiently than conventional methods.

2. Description of the Related Art

Concrete is a combination of cement, water and aggregate. It is a heavy, dense product that weighs approximately 150 pounds per cubic foot. Durable when cured and a very common building product, concrete is used in exterior and interior applications for floors, driveways, roads, sidewalks, and all manner of flat surfaces. Current placement practices seek to produce as flat a surface as possible but are often plagued by low spots. longitudinal ridges, and waves, Impediments to producing a flat surface include concrete stiffness or slump, the weight and denseness of the concrete, the curing properties of concrete, and the near impossibility of achieving flatness accuracy by eye alone.

Other inventors have attempted to solve the problem of laying flat concrete screed, and some inventions have utilized laser receivers for the purpose of laying concrete, but none of these inventions possesses the structural and functional attributes of the present invention. Several of these references are discussed below.

U.S. Patent Application Pub. No. 20100220167 (Kahle) discloses a lightweight, powered screed machine with a pair of rails and an elongated screed blade extending between them. A pair of posts is attached is attached to a frame on either end of the screed blade, and a pair of supports is positioned adjacent to each end of the blade. Each support has rollers for engaging and riding on one of the pair of rails, and each support is attached to the frame so as to support it over the concrete. Each support includes a linear actuator for raising and lowering the frame adjacent to the rail. A laser receiver is mounted on the top part of each post. A control controls the linear actuators and ensures that the screed blade is maintained at a desired height over the concrete. This invention requires extensive setup, and it is not self-pulling (it requires manual labor).

U.S. Pat. No. 6,672,797 (Zachman et al., 2004) describes a linear transducer arrangement in which control signals generated by the invention are used by a conventional control circuit to control the ends of a hydraulically movable tool having elevation receivers. As described by the inventors, the invention is a linear transducer arrangement for control of a tool carried by a machine, and more specifically, to a control system of a hydraulically moveable tool carried by a machine having laser receivers that receive actual elevational positions of the ends of the tool from an external laser transmitter. As is clear from the background section of this patent, the invention was intended for use in concrete paving operations. This particular invention represents the current state of the art for large slabs, but unlike the present invention, it is not designed for use with smaller or elevated slabs.

U.S. Patent Application Pub. No. 20020127058 (Zachman et al.) involves a control system and method for controlling a screed head in which individual hydraulically movable ends of a screed head carried by a boom of a machine are controlled so as to maintain a selected elevational position between each end of the screed head and a reference in a concrete paving application. An elevation receiver is mounted at each end of the screed head, and a sensor mounted on the screed head senses the orientation of the screed head along its length and provides a signal regarding such orientation. A control circuit, receiving signals from the elevation receivers and the sensor, controls the hydraulically moveable ends of the screed head accordingly. As with the previously discussed reference, this particular invention relies on hydraulics to move the screed head and is not designed for use with smaller or elevated slabs.

U.S. Pat. No. 5,190,396 (Aoyagi et al., 1993) provides a concrete leveler with rails that are laid on both sides of a concrete surface, a traveling beam that spans the rails and freely travels along them, a traveling unit that is mounted so as to be freely movable along the beam in a direction perpendicular with respect to the direction of travel of that beam, and a concrete leveler portion. The concrete leveler portion has a screw that is axially mounted so as to be freely and rotationally driven between support legs of the traveling unit, In a preferred embodiment, the invention includes an adjustment mechanism for adjusting and leveling the concrete leveler portion. As with U.S. Patent Application Pub. No. 20100221067, this invention is bound to the forms, which means that the accuracy of the invention is dependent on the precision with which the forms (referred to as "rails") are laid.

U.S. Pat. No. 5,156,487 (Haid) discloses a self-propelled power screed that is supported on two or more vertically adjustable ski-shaped bases, which are configured to manipulate the height of the screed relative to a freshly poured concrete surface. Each of the supports is powered by its own motor and independently adjustable to achieve a desired operating slope by extending or retracting the support means. Unlike the present invention, which does not rely on forms or rails for alignment, this invention is a truss screed riding on rails.

U.S. Pat. No. 8,152,409 (Ligman) describes an apparatus for screeding concrete comprising a rigid frame assembly, a telescopic boom assembly that is secured to the frame assembly, and a screeder head assembly with a plurality of vertically oriented alignment poles secured to the boom assembly. The telescopic boom includes a plurality of boom sections, each of which has a leveling mechanism in which each boom section may be individually leveled in relation to each preceding boom section. This invention incorporates sophisticated hydraulics that work well for large pours. With this invention, the entire boom is raised and lowered; by contrast, with the present invention, the truss does not move during operation of the screed, and the screed itself is moved up and down as dictated by the laser.

U.S. Pat. No. 5,567,075 (Allen, 1996) involves a laser-controlled automatic grade control system for finishing plastic concrete in which the finishing tool is mounted behind support towers to resist furrowing. A variety of elongated, multi-section concrete finishing tools such as triangular truss screeds are configured to connect or disconnect quickly from the tower system. Skis provide a support function and facilitate the sliding of the screeds over and through the plastic concrete. Adjustable vertical towers support the device along the length of the finishing tool, and the retraction and extension of the vertical towers is governed by a sensor-controlled system that is laser-operated.

U.S. Pat. No. 5,039,249 (Hansen et al., 1991) provides an apparatus for screeding or trowelling concrete, the apparatus having a turret mounted on a frame and a telescopic boom mounted on the turret. A machine head is mounted on the distal end of the boom and rotatable about a vertical axis, and a screed or trowel is attached to the machine head. The level and angle of the frame can be set to a selected elevation relative to a rotating laser beam by raising or lowering three hydraulic legs.

U.S. Pat. No. 5,871,302 (Carlson, 1999) discloses a truss assembly system comprised of alternating turnbuckles and tubular housings that define an interior space that houses an elongate rotatable shaft for providing vibration. The screed includes male and female joiner pieces having mating bearing surfaces for securing abutting screed sections. The invention incorporates a laser alignment system for adjusting the camber of the screeding surface.

BRIEF SUMMARY OF THE INVENTION

The present invention is a laser-controlled truss screed apparatus comprising: a laser; a mover; a truss assembly; and first and second receivers; wherein the truss assembly comprises a screed, a trolley, a truss, legs, and first and second vertical posts; wherein the first and second receivers are configured to receive a signal from the laser; wherein the mover is disposed on a first end of the truss, and the legs are disposed on a second end of the truss; wherein the first and second vertical posts, the trolley, and the screed are configured to form a single unit that travels back and forth along the truss; wherein the first vertical post comprises a bottom end that is secured to a first end of the screed, and the second vertical post comprises a bottom end that is secured to a second end of the screed; and wherein the legs are configured to raise and lower while maintaining a position of the truss relative to the wheels. In a preferred embodiment, the mover comprises four wheels, a platform that is configured to support a person, a steering wheel that is configured to control the wheels, and a handlebar. Preferably, the truss in passes from the legs through a center of the trolley and terminates above a front end of the mover.

In a preferred embodiment, the screed comprises a main body and a pivoting member; wherein the pivoting member is pivotally attached to the main body; and wherein both the pivoting member and the main body are oriented perpendicular to the truss and parallel to the trolley. Preferably, the main body is configured to be detached from the first and second vertical posts for transportation and cleaning. The pivoting member preferably comprises a vibrator that is configured to cause the pivoting member to vibrate during operation of the screed.

In a preferred embodiment, the truss is triangular in cross-section and comprises a top elongated member and two bottom elongated members that are configured to form a triangle shape when viewed from a front or rear end of the truss. Preferably, the truss comprises first and second linear bearing guides; wherein the first linear bearing guide is situated on top of the top elongated member; wherein the second linear bearing guide is situated between the two bottom elongated members; and wherein the trolley comprises a plurality of linear bearings that are coupled to and travel along the first and second linear bearing guides. The invention preferably further comprising a first pair of linear actuators that are configured to raise and lower the vertical posts. The invention preferably further comprises a second pair of linear actuators that are configured to raise and lower the screed without raising or lowering the first and second vertical posts.

In a preferred embodiment, the first vertical post passes through a first end of the trolley, and the second vertical post passes through a second end of the trolley; wherein the first end of the trolley comprises a first pair of guide rollers that are configured to engage with a front surface of the first vertical post and a first pair of centering rollers that are configured to engage with a rear surface of the first vertical post; and wherein the second end of the trolley comprises a second pair of guide rollers that are configured to engage with a front surface of the second vertical post and a second pair of centering rollers that are configured to engage with a rear surface of the second vertical post. Preferably, the screed is comprised of a U-shaped member with first and second knife edges that run parallel to each other along a width of the screed; wherein the first and second knife edges are configured to make contact with a ground surface when the screed is in operation: and wherein the pivoting member comprises a flat bottom plate that is configured to ride on top of and to flatten a wet concrete surface after it has been scraped by the first and second knife edges. The U-shaped member preferably comprises a roller that is situated between the first and second knife edges and configured to make contact with the wet concrete surface after the first knife edges scrapes the wet concrete surface and before the second knife edges scrapes the wet concrete surface.

REFERENCE NUMBERS

Figure 1:
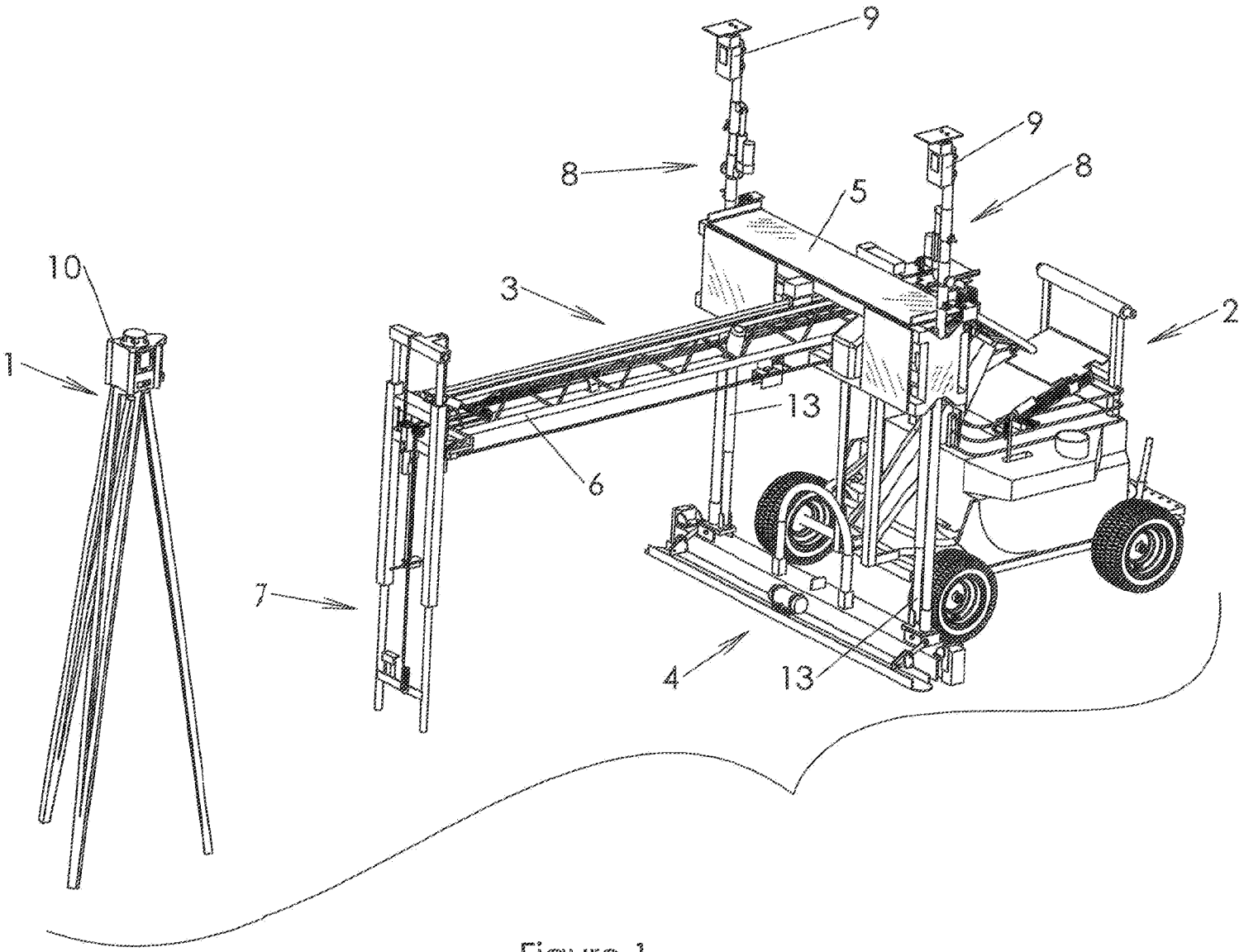
FIG. 1 is a first perspective view of the present invention including the laser tower shown with the trolley in a home position.

1 Laser tower
2 Mover
3 Truss assembly
4 Screed
5 Trolley
5*a* Trolley housing
6 Truss
7 Legs
8 Vertical post
9 Receiver
10 Laser
11 Cover plate
12 Battery compartment
13 Linear actuator
14 Platform
15 Handlebar
16 Steering wheel
17 Wheels
18 Stake
18*a* Sleeve
19 Screed assembly
20 Main body (of screed)
21 Pivoting member (of screed)
22 Handle (on main body of screed)
23 Vibrator
24 Throttle
25 Brake lever
26 Top elongated member (of truss)
27 Bottom elongated member (of truss)
28 Linear bearing
29 Light panel
30 Linear actuator
31 Chain
31*a* First chain
31*b* Second chain
31*c* Third chain
32 Converter
33 Toggle switch
34 Fob
35 Platform
36 Linear bearing guide
37 Trolley motor
38 Limit switch(es)
39 Bracket
40 Top bar
41 Stop (on legs)
42 First pair of lever switches
43 Second pair of lever switches
44 Platform
45 Protrusion
46 Stop (on vertical post)
47 Third pair of lever switches
48 Stop (on underside of platform 44)
49 Stop (on legs)
50 Plate
51 U-shaped member
51*a* First knife edge
51*b* Second knife edge
51*c* Ear
51*d* First side wall (of U-shaped member)
51*e* Second side wall (of U-shaped member)
51*f* Shaft housing
52 Roller (on screed)
53 Remote control unit
54 Gear
55 Power cord
56 Pulley
57 Bungee cord
58 Linear actuator
59 Knob
60 Stop (on legs)
61 Bumper
62 Spring assembly
63 Stop (on spring assembly)
64 Guide roller
65 Centering roller
66 Motor
67 Piston
68 Button
69 Limit switch (plunger-style)
70 Electric relay
71 Spring
72 Stop (on legs)

DETAILED DESCRIPTION OF INVENTION

A. Overview

Concrete slump is the technical measurement of the stiffness of fresh concrete and is of significant consideration in placing concrete. The stiffer the concrete, the harder it is to screed and work. Concrete strength and durability is almost solely dependent upon cement in significant quantity and the amount of water added to the cement. This is referred to as the water-to-cement (w/c) ratio. Cured concrete is a matrix of rock, sand and cement. (Exterior concrete also has microscopic air bubbles for durability.) This matrix is roughly by volume three units of rock, two units of sand, one unit of cement, and a half unit of water, resulting in a w/c ratio of 0.5. This w/e ratio is important because as the ratio increases, the strength of the concrete decreases, but the workability increases. In simple terms, the wetter the concrete, the easier it is to work and flatten, but the weaker and softer it is—and also the more prone to cracks and fatigue. This results in poor quality and an undesirable product. For this reason, quality flat work and slabs are routinely placed at a w/c ratio of less than 0.5, and this concrete is heavy and stiff, requiring powerful inputs to work the surface flat.

The term "powerful inputs" refers to the energy required to work a concrete surface. By way of illustration, consider the placement of concrete for a sidewalk. Sidewalks are five to six feet wide, commonly poured four to six inches thick on a compacted graded subgrade with a rectangular (two-by-four) form on each side. Fresh concrete is poured from a concrete truck into the forms. The concrete must then be raked with hand tools to a level slightly above the forms. Then two workers use a rod (or a screed) to pull the concrete surface flat by dragging the screed on the top surface of the forms, The flatness of the sidewalk is dependent on the correctness of the forms and the skill of the workers to consolidate and screed the concrete surface. Further finishing work follows as the concrete cures and hardens to leave a smooth, even surface, Even with competent finishing practice, most of the flatness of the concrete is produced by the screeding process.

Applying the concept of powerful inputs to the scenario described above, raking and screeding a six-foot surface requires two workers, pulling 30 to 60 pounds each, depending upon slump and the amount of concrete being stricken off (generally one to three inches is pulled by the screed). This powerful input or work effort to screed or strike off the surface is an important component of the problem that is solved by the present invention; however, the most difficult facet of the problem solved by the present invention is maintaining the constant flat travel movement of the screed during the screeding process.

Producing extremely flat screed travel necessitates stability. If there is nothing stable to hold the screed flat during travel, then slab flatness suffers. In the above sidewalk example, the forms at the edge of the sidewalk pour provide the potential for flatness as the screed slides along the top of the forms, but this requires accurate placement of the forms. When the slab is wider than six to ten feet, a hand screed becomes impractical; in this situation, some other form of control must hold flat and move the screed to strike off and consolidate the concrete.

The present invention is a laser-controlled truss screed in which a rotating red laser is placed to spin in a horizontal or precisely tilted plane and provide a reference for the elevation of the screed. The material surface is screeded to a constant distance from the laser reference plane. The present invention utilizes a laser receiver attached to a vertical pole, which is fixed at the bottom to one end of a screed. The other end of the screed is attached to a second vertical pole with another laser receiver at the top of the pole. Each receiver is set to a constant distance between the laser reference plane and the desired screed elevation. In a preferred embodiment, each receiver has multiple photodiodes along a vertical line space 0.1 inch apart. This enables each receiver to determine where the laser is to within about 0.1 inch. If the laser is not hitting the photodiodes at the center of the line, then the receiver generates a signal to move the screed up or down to bring the laser back onto the center of the photodiodes. That signal is used to activate a linear positioner motor to extend or retract the screed. With a receiver and positioner at each end of the screed, a constant elevation of the screed relative to the laser plane is maintained.

In order to hold the screed at a desired consistent height, the present invention incorporates a trolley riding on an aluminum truss. The truss and trolley are strong and rigid and provide a mechanical means for pulling concrete with the screed. The truss and trolley are sufficiently elevated above the screed to allow the concrete to be consolidated, hand raked, and adjusted to grade in preparation for screeding. In the present invention, the screed is in the form of a channel screed comprised of two separate screeding surfaces. The front face or knife edge is responsible for edge dozing, raking, and filling the surface to grade, while the rear face or knife edge more finely rakes, consolidates and flattens the surface. Optionally, a roller may be placed between the two faces of the channel screed, further consolidating the stiffer concrete. Following the screed, a vibrating float completes the flattening process.

B. Detailed Description of the Figures

FIG. 1 is a first perspective view of the present invention including the laser tower shown with the trolley in a home position. As used herein, the term "home position" means that the trolley is in its rear-most position on the truss. As shown in this figure, the present invention comprises a laser tower 1, a mover 2, and a truss assembly 3. The truss assembly 3 comprises a screed 4, a trolley 5, a truss 6, legs 7, and two vertical posts 8 with a receiver 9 situated on top of each vertical post. In this embodiment, the laser tower 1 is in the form of a tripod with a laser 10 disposed on top of it.

Figure 2:
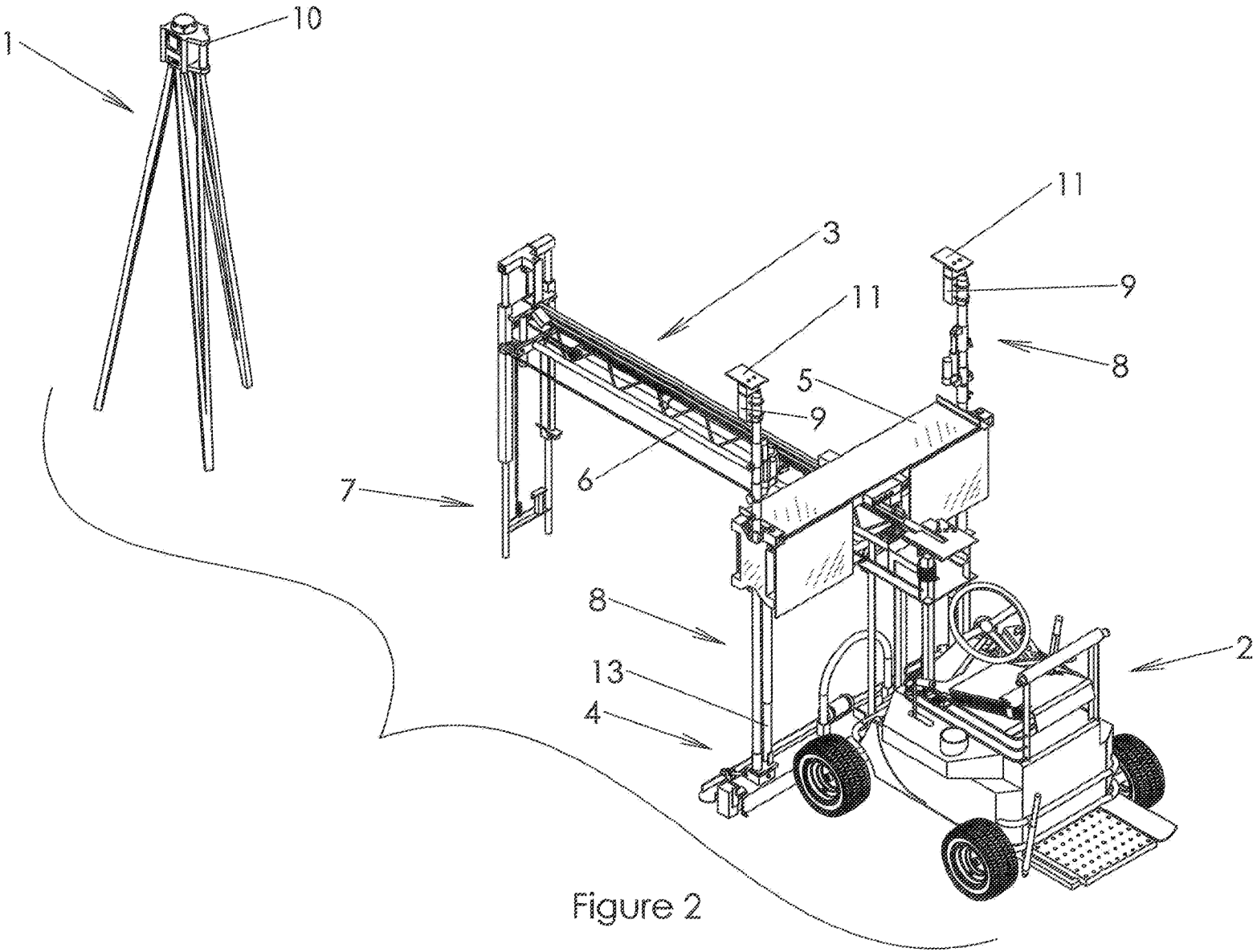
FIG. 2 is a second perspective view of the present invention including the laser tower shown with the trolley in a home position.

FIG. 2 is a second perspective view of the present invention including the laser tower shown with the trolley in a home position. In a preferred embodiment, a cover plate 11 is situated on top of each receiver 9. The purpose of the cover plate 11 is to make it easier for the operator to view the lights on the front face of the receiver 9. The vertical posts 8, trolley 5 and screed 4 make up a single unit that travels back and forth (horizontally) along the truss 6. The bottom end of each vertical post 8 is secured to one end of the screed 4, and a vertical post 8 passes through each side of the trolley 5, as shown. The mover 2 is situated behind the truss assembly 3, and the rear end of the truss 6 is spaced above and secured to the front end of the mover 2 via various supports, as shown.

Figure 3:
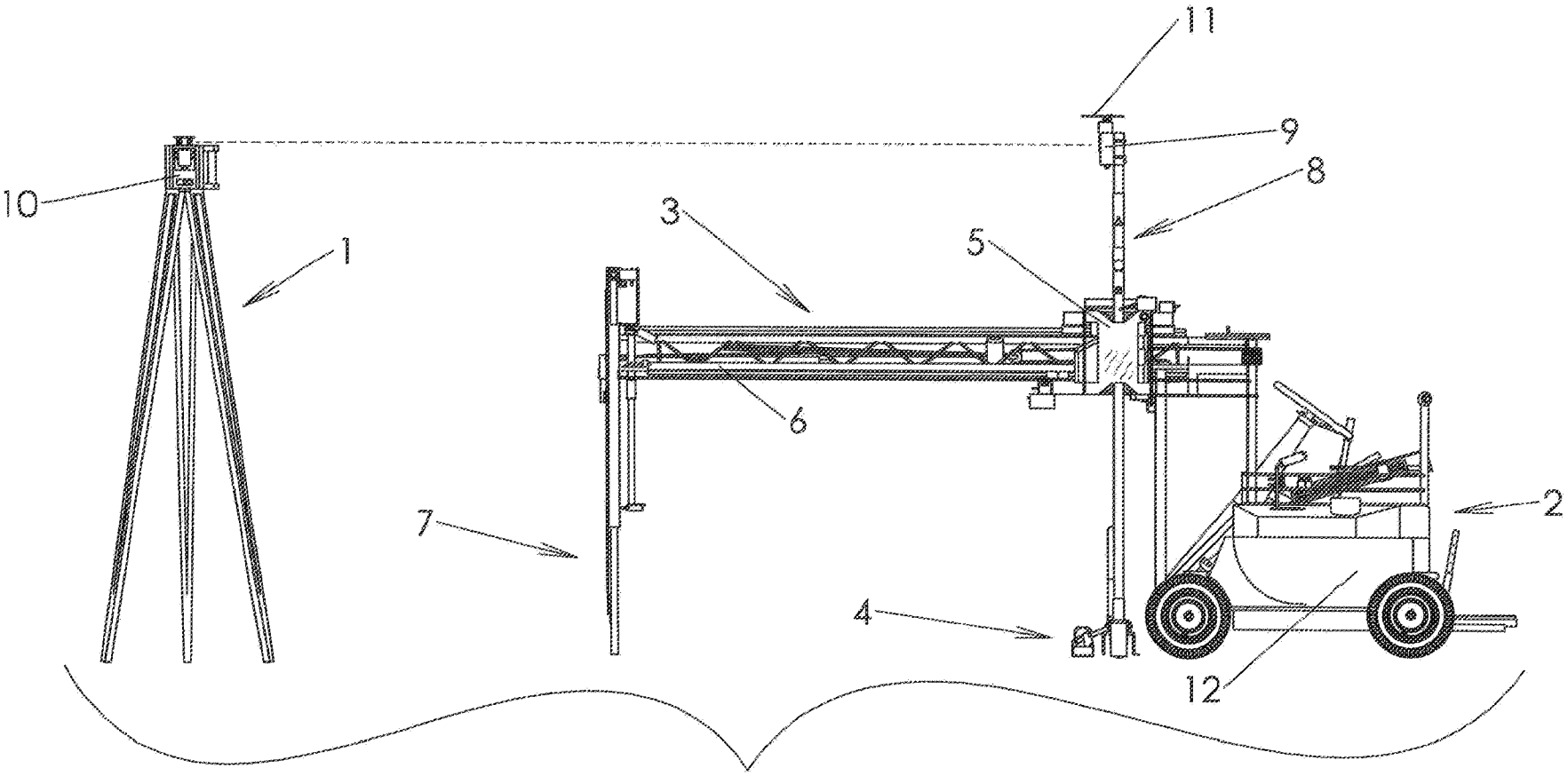
FIG. 3 is a side view of the present invention including the laser tower shown with the trolley in a home position.

FIG. 3 is a side view of the present invention including the laser tower shown with the trolley in a home position. Prior to operation of the truss assembly, the laser 10 must be lined up with the receivers 9 so that they are on the same plane. The laser 10 projects the plane, and the receivers 9 must be centered on the laser prior to operation of the screed. In a preferred embodiment, the laser 10 is a dual-slope laser, which means that the present invention can be used to pour level concrete, single-slope concrete, or dual-slope concrete surfaces. In a preferred embodiment, the receiver 9 comprises a Ruggeduino™ microcontroller board that is configured to receive and execute commands from a remote control handheld unit (not shown). To line the receivers 9 up with the laser 10, the operator sends a signal to the receivers 9 via the remote control unit, the receivers look for the laser beam that is emitted by the laser, and the microcontroller board within each receiver sends a signal to a linear actuator 13 (see FIG. 1) that is configured to raise or lower the vertical post 8 until the laser is centered on the receiver. Once the receivers 9 are locked onto the laser 10, the linear actuators 13 ensure that the receivers stay locked on the laser during operation of the screed, thereby forcing the plane to stay the same.

In a preferred embodiment, a pair of legs 7 is configured to raise or lower depending on the position of the brake (not shown) on the mover 2. When the brake is in an "off" position, the legs 7 are raised in relation to the truss 6 (see FIG. 11). When the brake is in an "on" position, the legs 7 are lowered so that they come into contact with the ground surface, as shown in FIG. 3. In a preferred embodiment, the present invention is self-propelled and all-electric. The power is supplied by one or more batteries that are contained within a compartment 12 on the mower 2.

Figure 4:
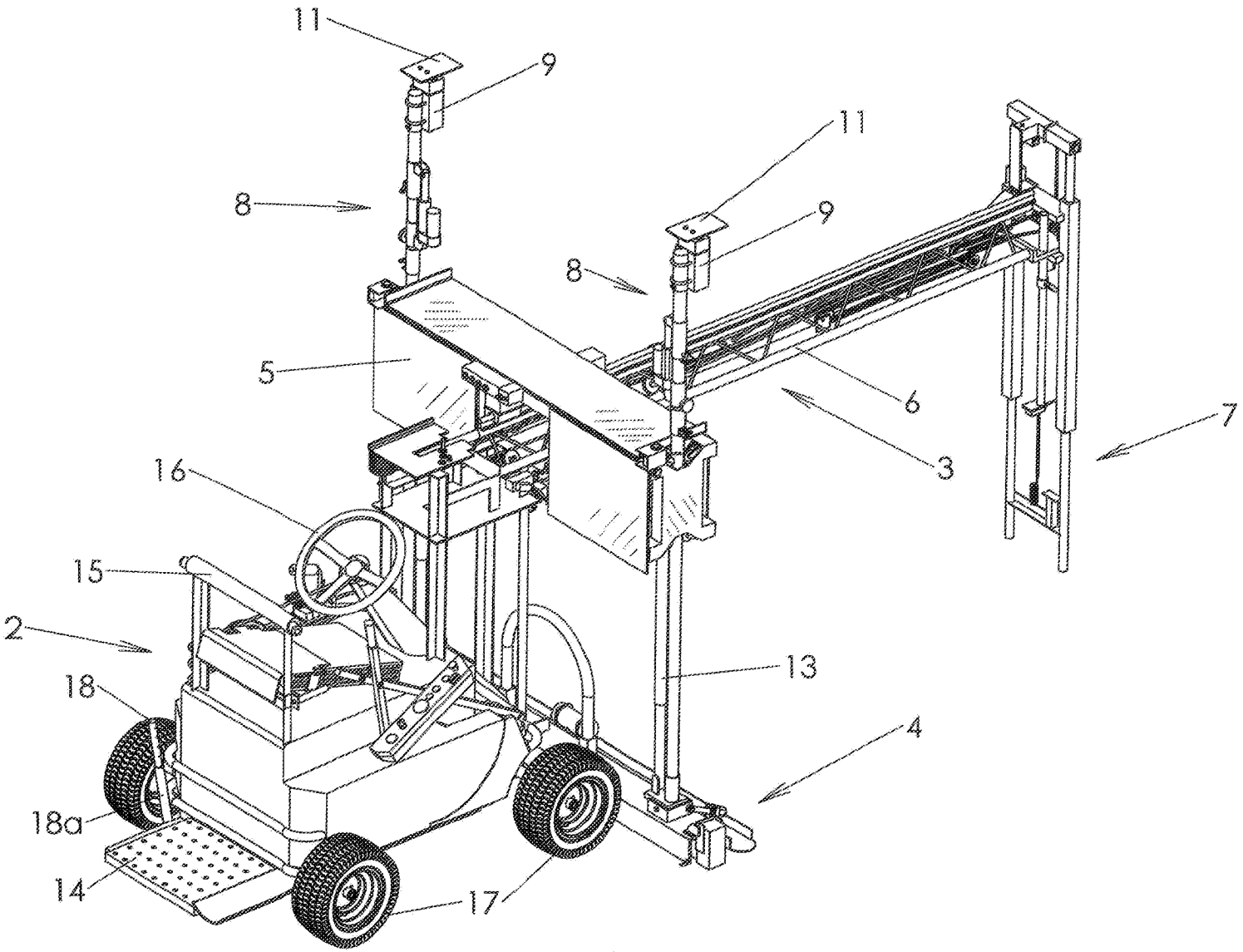
FIG. 4 is a rear perspective view of the present invention shown without the laser tower shown and with the trolley in a home position.
Figure 5:
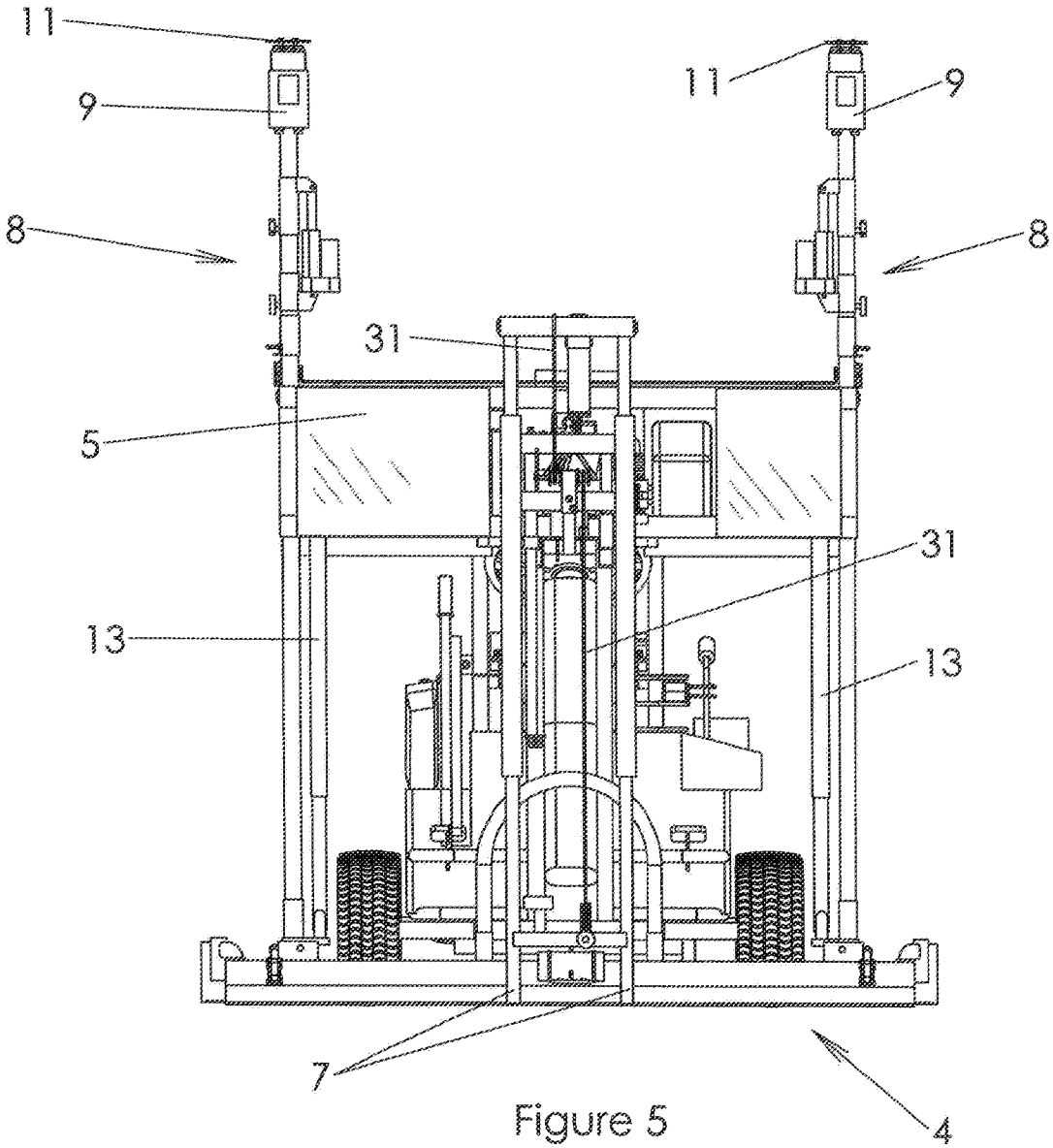
FIG. 5 is a front view of the present invention shown without the laser tower shown and with the trolley in a home position.

FIG. 4 is a rear perspective view of the present invention shown without the laser tower and shown with the trolley in a home position. As shown in this figure, the mover 2 preferably comprises platform 14 at the rear of the mower. The platform 14 is configured to allow the operator to stand on it, and a handlebar 15 is also provided to allow the operator to hold onto it when the mover 2 is moving. The steering wheel 16 is configured to control the wheels 17, of which there are preferably four, as shown. An optional stake 18 is provided. This stake 18 is positioned within a sleeve 18*a* and secured in the sleeve with a pin (not shown). The stake 18 can be drive into the ground (with the pin removed and the stake still in the sleeve) in order to provide additional stability to the mover, if needed. The invention is configured so that the truss 6 is always virtually level relative to the wheels 17, FIG. 5 is a front view of the present invention shown without the laser tower and shown with the trolley in a home position. In this figure, the bottom ends of the legs 7 are resting on the ground surface, as is the screed 4. The linear actuators 13 are also clearly visible in this figure. In all of FIGS. 1-5, the trolley 5, vertical posts 8 and screed 4 are in a retracted position; that is, the trolley 5 is in its rearmost position, closest to the mover 2. In subsequent figures, the trolley 5, vertical posts 8 and screed 4 are shown in an extended position, further from the mover 2, and proximate to the legs 7 (see FIGS. 7-10). For ease of reference, the unit that is comprised of the trolley 5, vertical posts 8 and screed 4 will be referred to herein as the screed assembly 19. Note that the truss 6 passes through the center of the trolley 5 and terminates above the front end of the mover 2, as described above.

Figure 6:
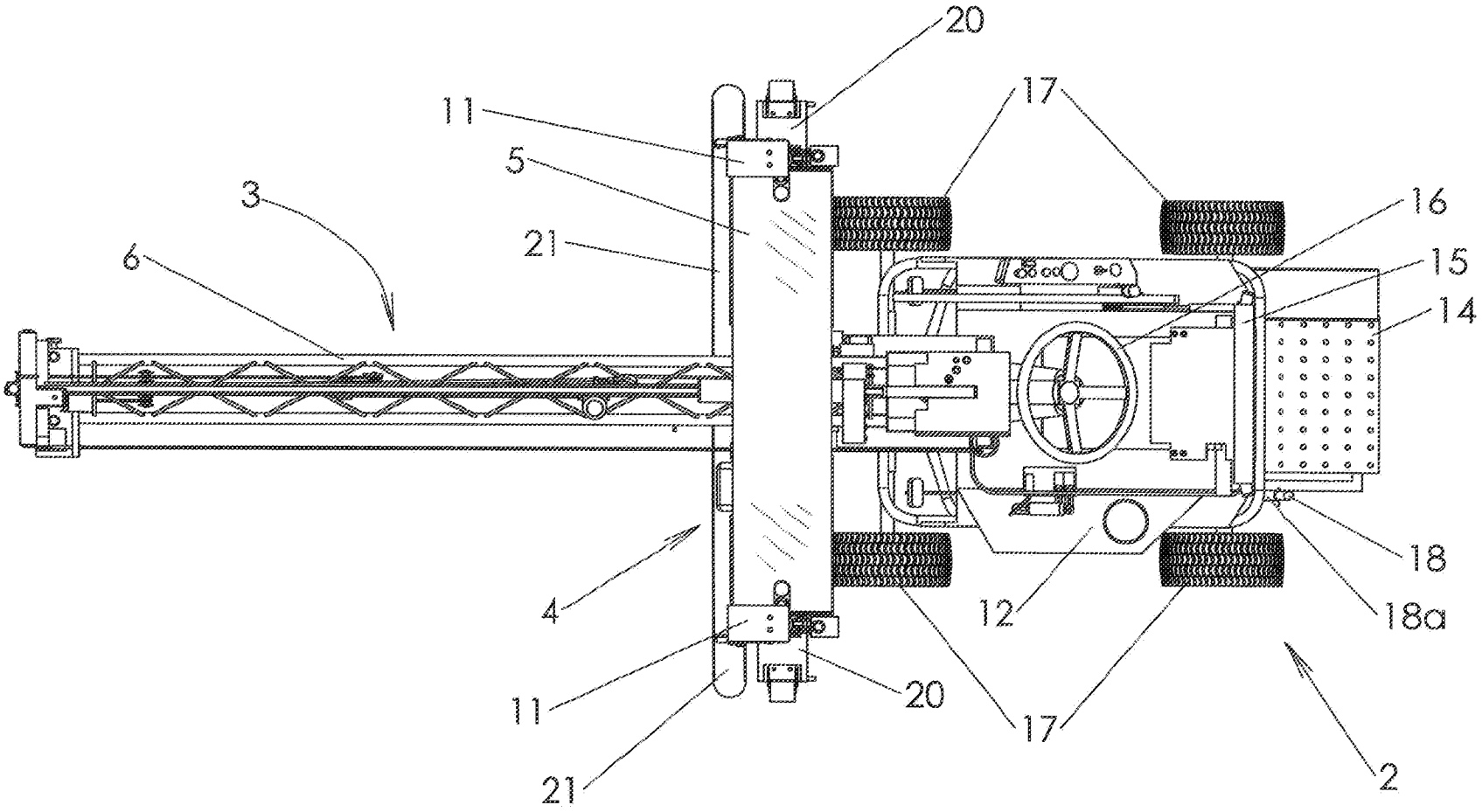
FIG. 6 is a top view of the present invention shown without the laser tower shown and with the trolley in a home position.

FIG. 6 is a top view of the present invention shown without the laser tower and shown with the trolley in a home position. As shown in this figure, the screed 4 is comprised of two parts. The first part is the main body 20, and the second part is the pivoting member 21. As you can see from this figure, the main body 20 and pivoting member 21 are the same length, and they are both oriented perpendicular to the truss 6 and parallel to the trolley 5. This figure also shows that the rear end of the truss 6 is situated over the front end of the mover 2.

Figure 7:
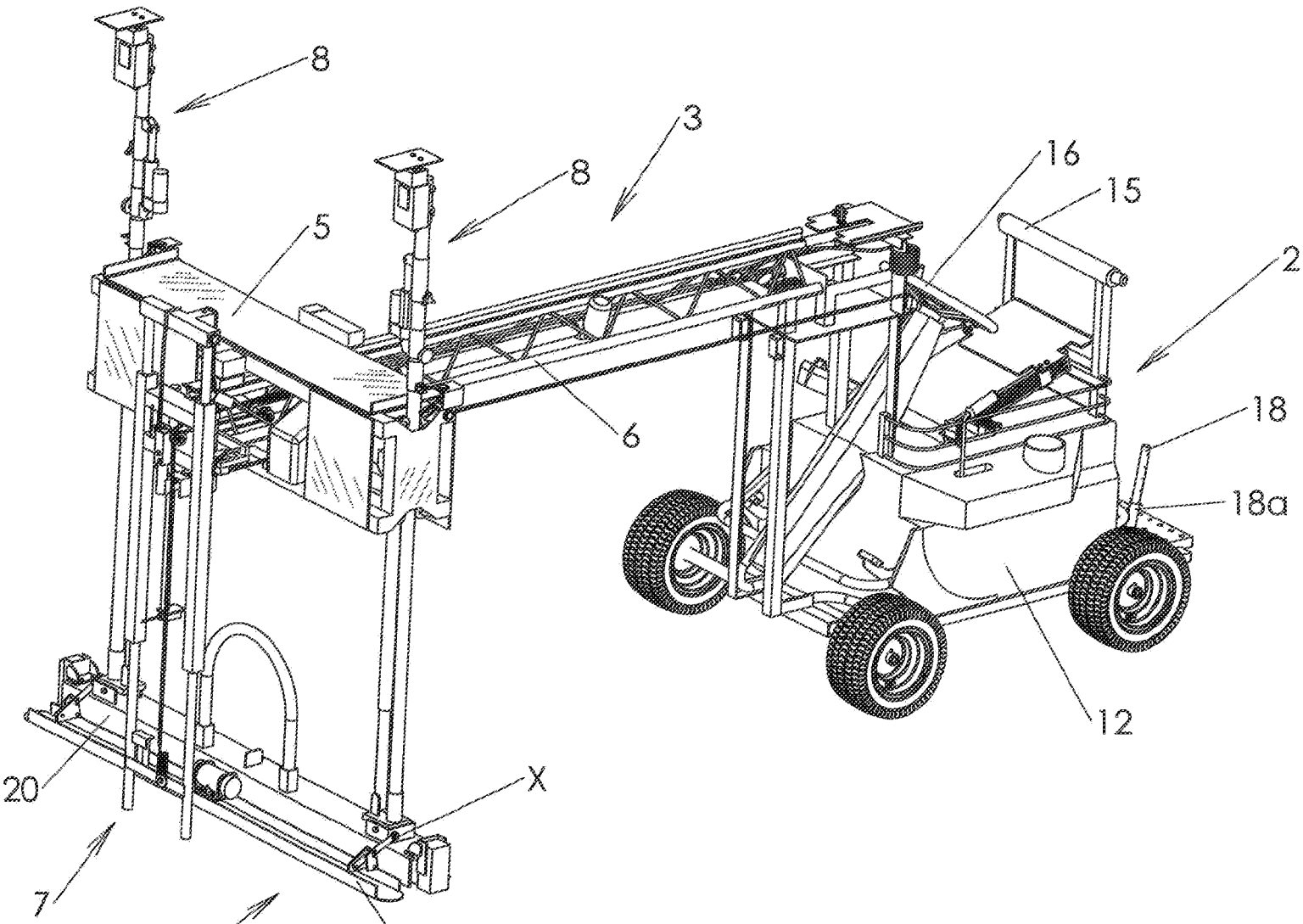
FIG. 7 is a perspective view of the present invention shown without the laser tower and shown with the trolley in an extended position prior to screeding.

FIG. 7 is a first perspective view of the present invention shown without the laser tower and shown with the trolley in an extended position prior to screeding. The trolley 5 is configured to move along the length of the truss 6 until it triggers a stop (not shown) at the legs 7. Thus, when the trolley 5 is in its furthest position from the mover 2, it is situated on the truss directly adjacent to the legs 7, which are attached to the front end of the truss 6. Note that the trolley 5, screed 4 and vertical posts 8 have all moved as a unit. The main body 20 of the screed 4 preferably comprises a handle 22. The pivoting member 21 is pivotally attached to the main body 20 at pivot points "X" (see also FIG. 8). When the screed 4 is in operation, the pivoting member 21 "floats" on top of the wet concrete surface, following the main body 20. The main body 20 is preferably configured so that it can be unbolted and separated from the bottom ends of the vertical posts 8 for transportation or cleaning.

Figure 8:
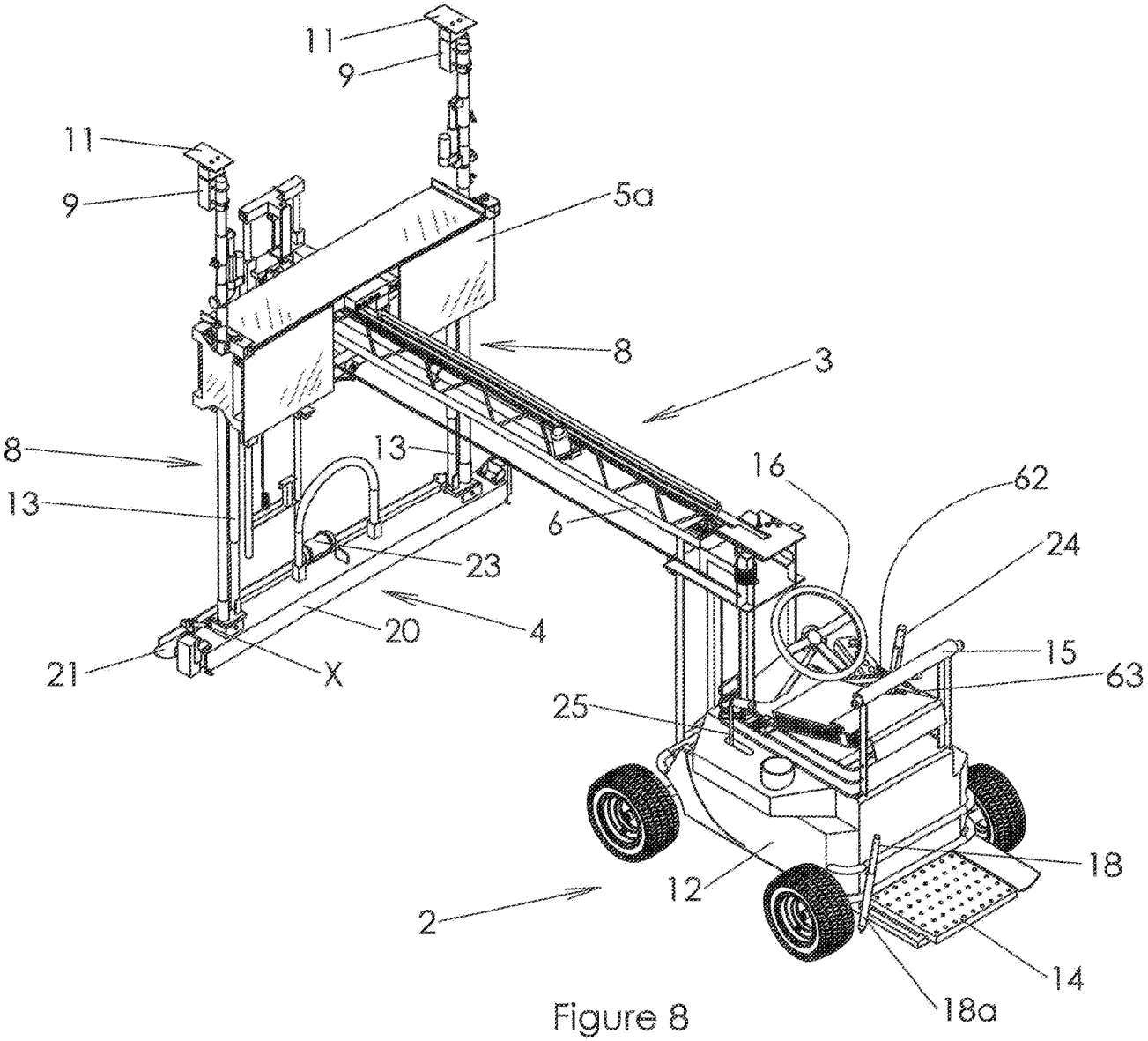
FIG. 8 is a second perspective view of the present invention shown without the laser tower and shown with the trolley in an extended position prior to screeding.

FIG. 8 is a second perspective view of the present invention shown without the laser tower and shown with the trolley in an extended position prior to screeding. As shown in this and the preceding figure, the pivoting member 21 preferably comprises a vibrator 23 that sits on the pivoting member 21 and causes it to vibrate during operation of the screed 4. The trolley housing Sa contains two converters (not shown) that produce 12-volt power for the receivers 9, linear actuators, 13, legs 7 and other electric components of the system. The movement of the trolley 5 on the truss 6 is effectuated via a chain-and-gear system that is described in connection with subsequent figures. An inverter (not shown) on the mover 2 converts 48 volts D/C to 120 volts A/C to power the trolley motor 37, the two converters 32, both of which convert 120 A/C to 12-volt D/C, and the vibrator 23. The mover 2 is controlled by a throttle 24. In a preferred embodiment, a spring assembly 62 with a stop 63 is configured to prevent the throttle 24 from being push too far forward too quickly. The mover 2 also includes a brake lever 25, which is discussed further below.

Figure 9:
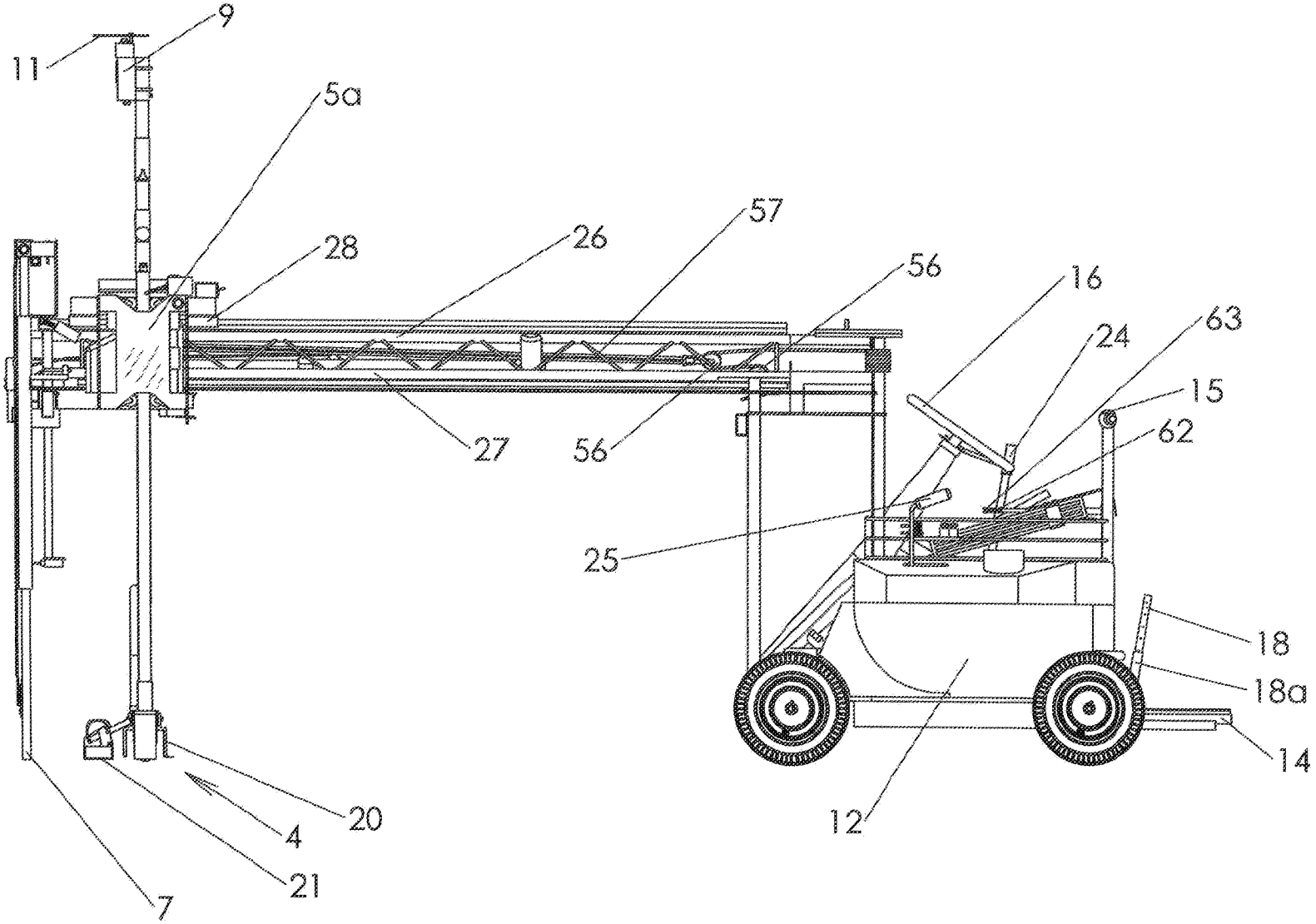
FIG. 9 is a side view of the present invention shown without the laser tower and shown with the trolley in an extended position prior to screeding.

FIG. 9 is a side view of the present invention shown without the laser tower and shown with the trolley in an extended position prior to screeding. As shown in this figure, the truss 6 comprises a top elongated member 26 that extends across the length of the truss and forms the top-most edge of the truss. In a preferred embodiment, the truss 6 is triangular in shape in cross-section; that is, in addition to the top elongated member 26, which is situated directly underneath a linear bearing guide 36, the truss comprises two bottom elongated members 27. The three elongated members are configured to form a triangle shape when viewed from the front or rear end of the truss. The invention also comprises four linear bearings 28, two of which are disposed around at least part of the linear bearing guide 36 that sits on top of the top elongated member 26, and two of which are disposed around at least part of a linear bearing guide 36 that is situated between the two bottom elongated members 27 (see FIG. 25). All four of the linear bearings 28 are attached to the trolley S and travel with it. The elongated members 26, 27, on the other hand, are stationary. The linear bearings 28 are shown in FIGS. 13, 14, 24, 25 and 26.

Figure 10:
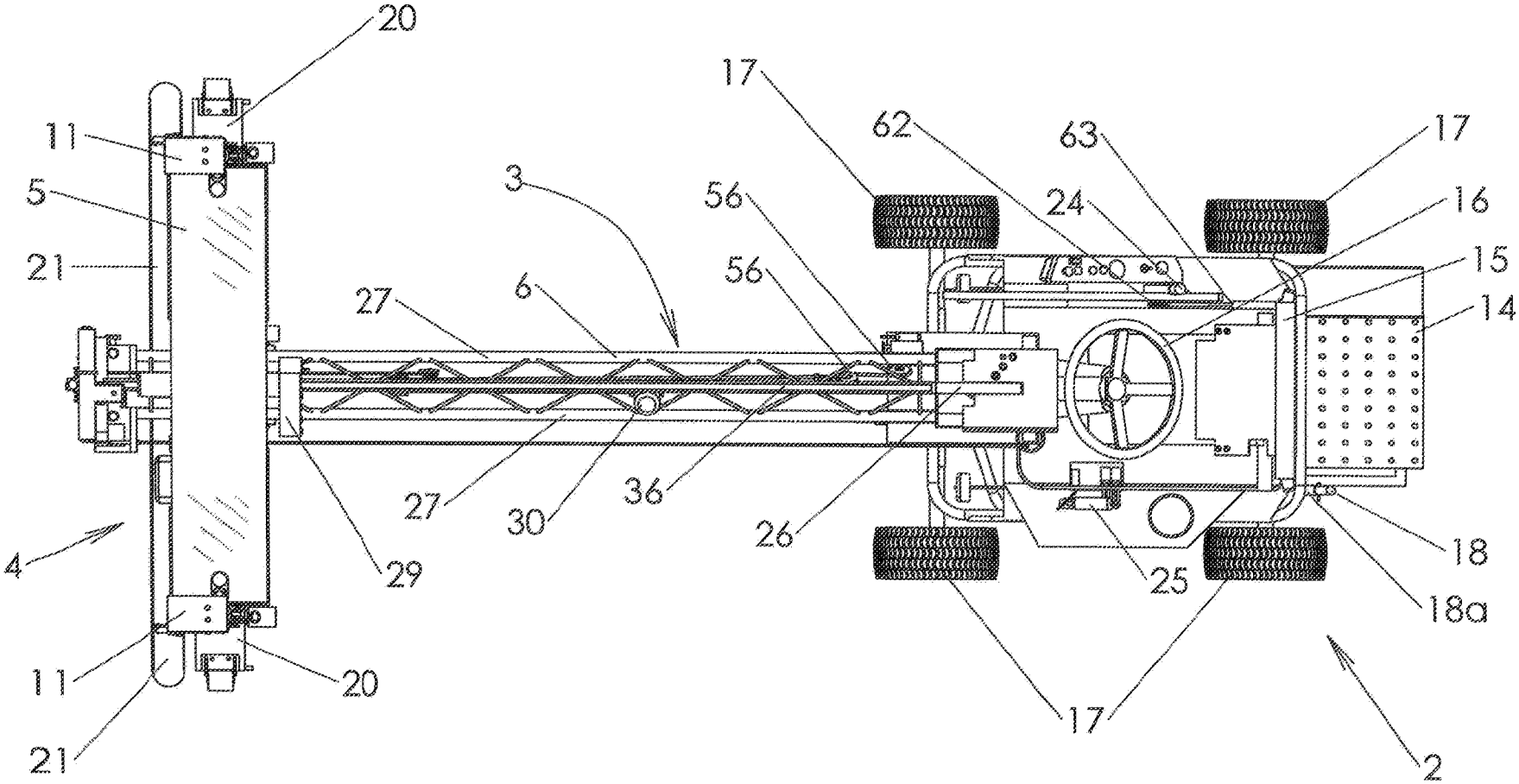
FIG. 10 is a top view of the present invention shown without the laser tower and shown with the trolley in an extended position prior to screeding.

FIG. 10 is a top view of the present invention shown without the laser tower and shown with the trolly in an extended position prior to screeding. This figure clearly shows the orientation of the top elongated member 26 in relation to the two bottom elongated members 27. It also shows the linear bearing guide 36 that is situated directly on top of the top elongated member 26. An optional light panel 29 is attached to the rear of the trolley to indicate various stages of operation (e.g., screed moving out, screed raised by half an inch to "doze," or screed back down to grade and in operation). A linear actuator 30 is situated in the truss 6 and controlled by the brake lever 25. This linear actuator 30 controls a chain that is configured to cause the legs 7 to raise (see discussion of FIGS. 16-19 below), This linear actuator 30 is controlled by the lever switches 42, 43.

Figure 11:
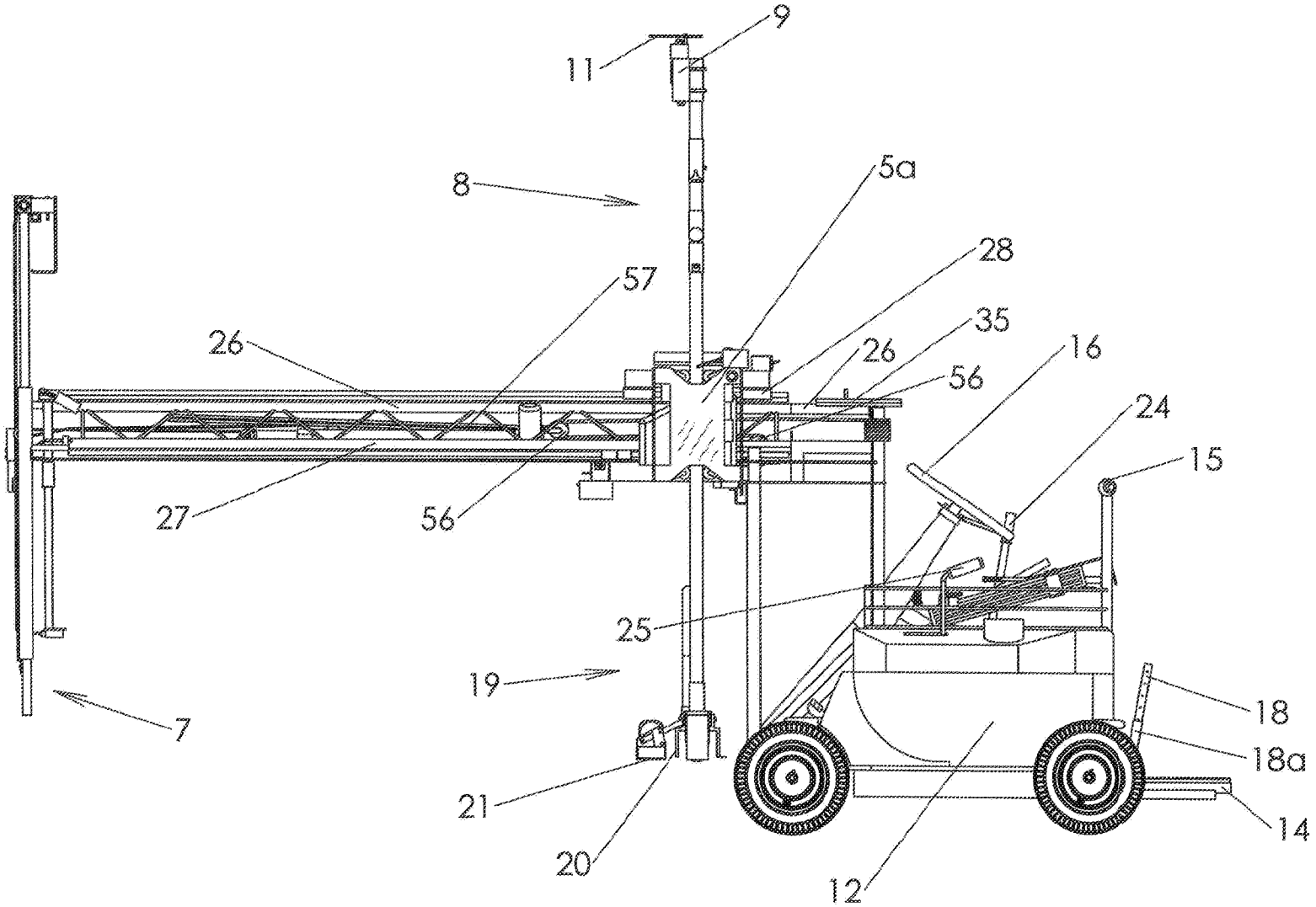
FIG. 11 is a side view of the present invention shown without the laser tower and shown with the trolley in a home position and the screed assembly in travel mode.

FIG. 11 is a side view of the present invention shown without the laser tower and shown with the trolley in a home position. Aside from the fact that the laser tower is omitted, the difference between this figure and FIG. 3 is that the screed assembly 19 and legs 7 have both been lifted so that they can easily clear the ground surface. This position is referred to as "travel mode." The invention would be in this position prior to arriving at the job site.

Figure 12:
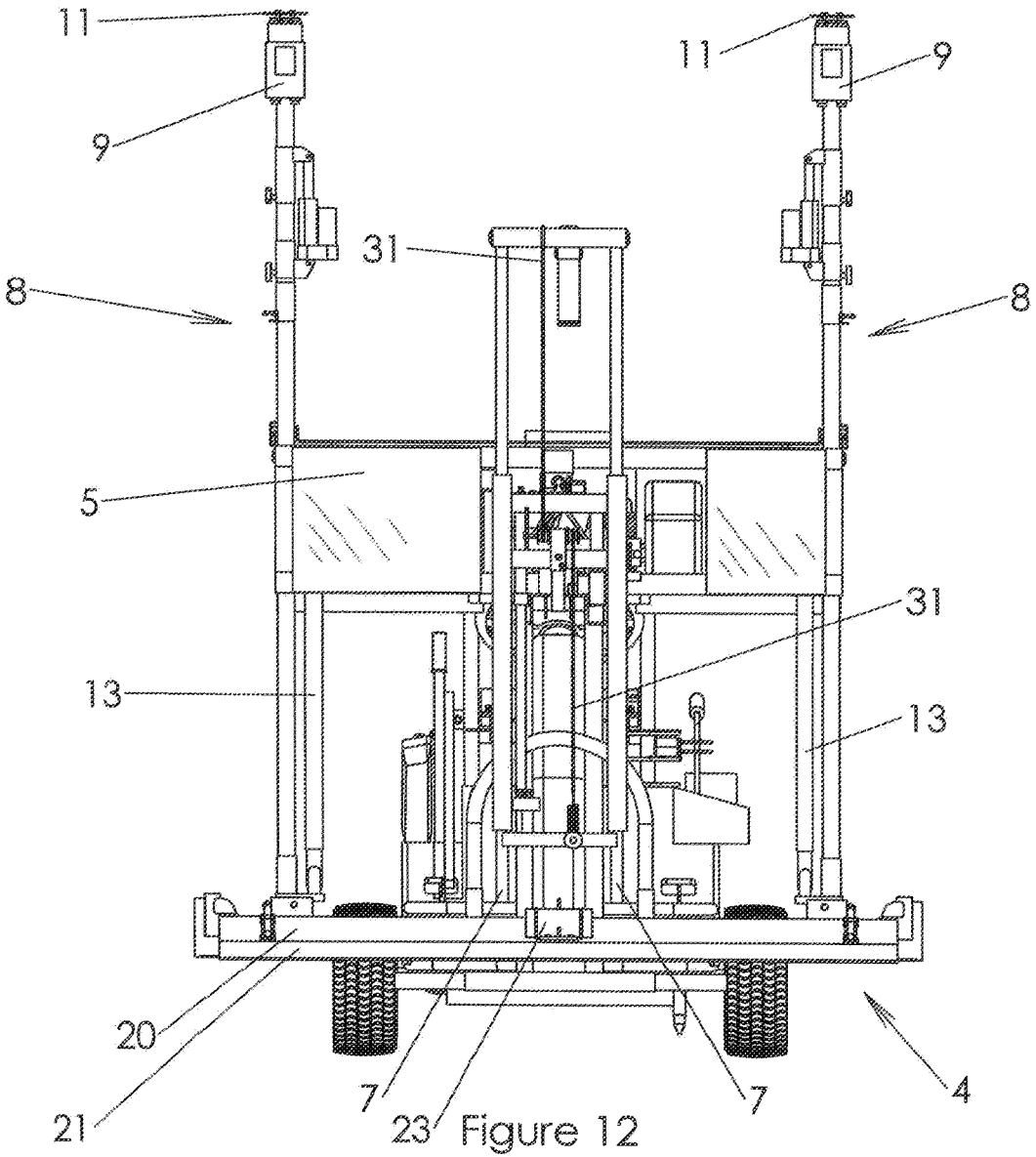
FIG. 12 is a side view of the present invention shown without the laser tower and shown with the trolley in a home position and with the screed assembly in travel mode.

FIG. 12 is a side view of the present invention shown without the laser tower and shown with the trolley in a home position and with the screed assembly in travel mode. The height of the legs 7 relative to the wheels 17 is clearly depicted in this figure; compare this figure to FIG. 5, in which the screed assembly 19 and legs 7 are in an operational position at ground level. The height of the screed assembly is controlled by the linear actuators 13 that are situated adjacent to the bottom of the vertical posts 8. The height of the legs is controlled by the chain that is described below in connection with FIGS. 16-19.

Figure 13:
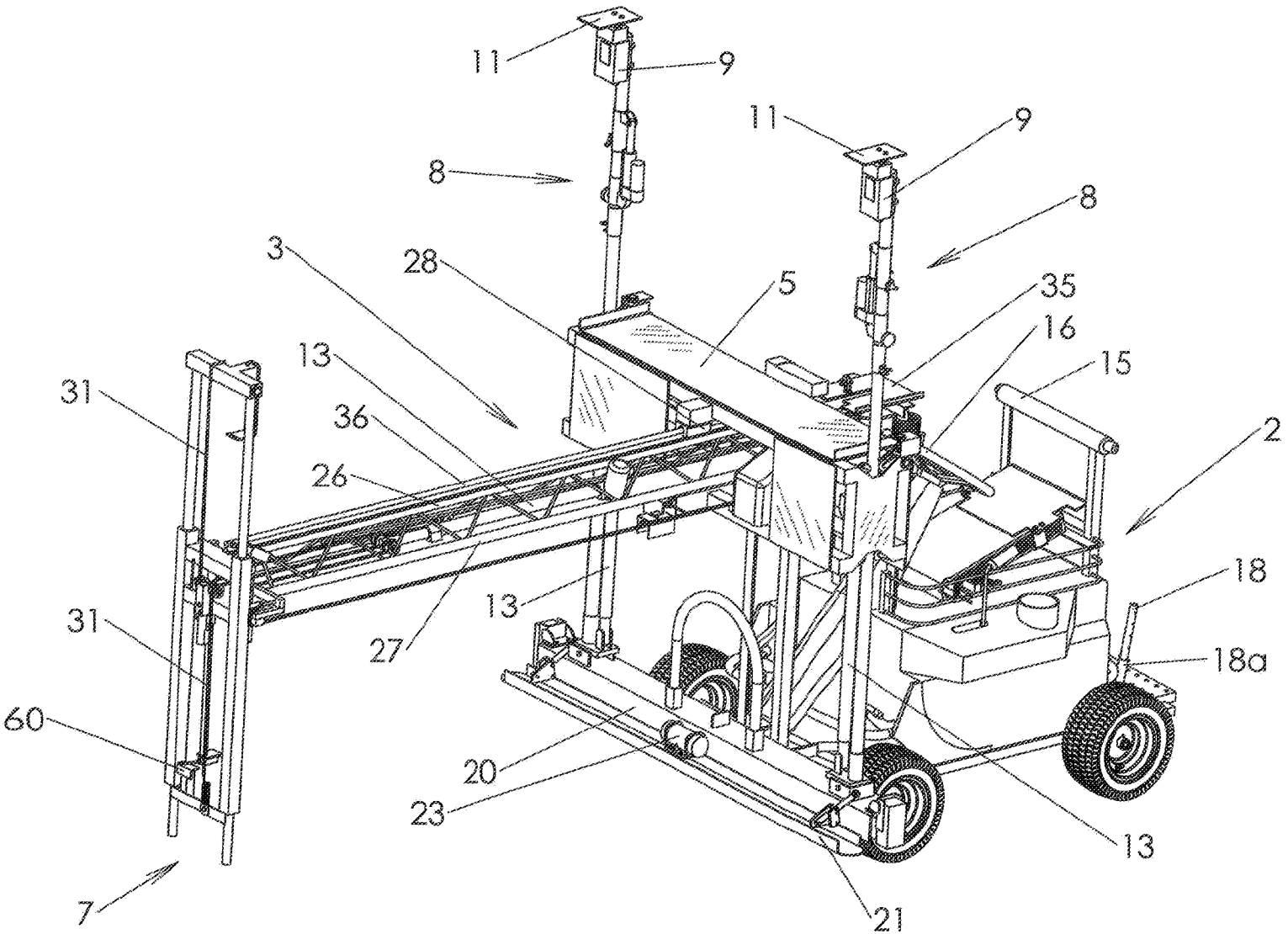
FIG. 13 is the same view of the present invention as shown in FIG. 12 except that the screed 4 has been removed for transportation.

FIG. 13 is the same view of the present invention as shown in FIG. 12 except that the screed 4 has been removed for transportation. In this figure, the main body 20 of the screed 4 has been unbolted from the bottom ends of the vertical posts 8 and stowed for transportation. In this figure, the vertical posts 8 and legs 7 are still raised, as in the previous figure. The stop 49, which is discussed below, also functions as handle to facilitate manual lifting of the legs.

Figure 14:
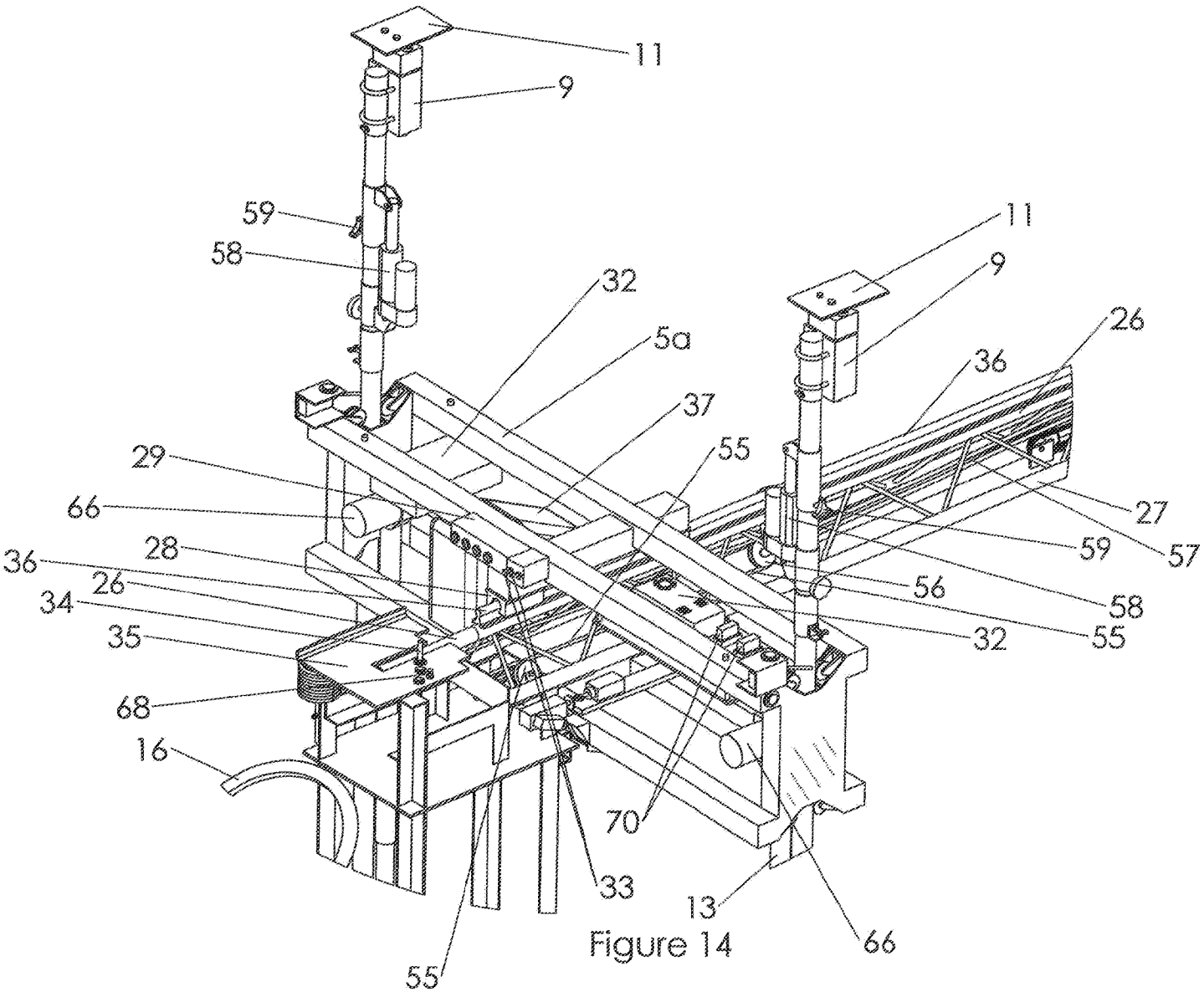
FIG. 14 is a detail rear perspective view of the trolley shown with the trolley housing removed.

FIG. 14 is a detail rear perspective view of the trolley shown with the trolley housing removed. Note that the trolley housing 5*a* is omitted for clarity in all subsequent figures. Note also that the electric wiring has been omitted from all of the figures for ease of illustration. This figure shows the two converters 32 that are discussed above. It also shows the light panel 29. Two toggle switches 33 on the same panel control the two linear actuators 13. (The motors 66 for these two linear actuators 13 are shown in FIG. 14.) A small platform 35 to the rear of the trolley 5 and secured to the top elongated member 26 supports an optional fob 34 for securing the remote control unit 53 to the platform and a button 68 that is discussed below in connection with FIGS. 23 and 24. Optional linear actuators 58 situated on the top part of each vertical post 8 can be used to raise the screed 4 by half an inch without raising the vertical posts 8 (so that the vertical posts 8 stay locked on the laser). You would want to do this if the accumulation of concrete on the rear side of the first knife edge 51*a* (that is, the edge that is closest to the mover 2) is too great to continue screeding without removing the accumulated concrete. Knobs 59 situated on each vertical post 8 proximate to the linear actuator 58 are used to remove the top part of the vertical post (which is telescopically coupled to the rest of the vertical post) for disassembly. This figure also shows a pair of electric relays 70.

Figure 15:
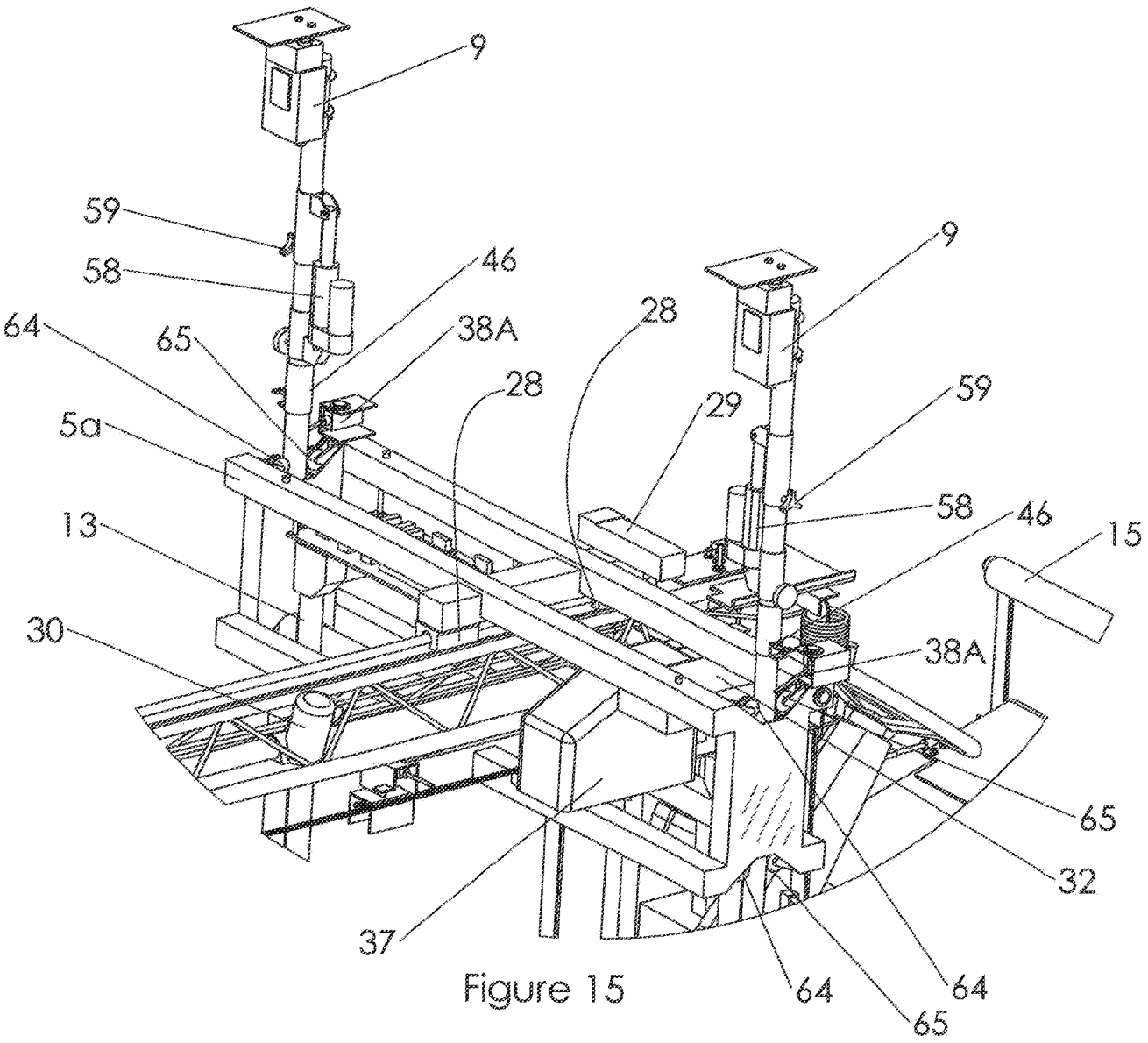
FIG. 15 is a detail front perspective view of the trolley shown with the trolley housing removed.

FIG. 15 is a detail front perspective view of the trolley shown with the trolley housing removed. This figure shows the trolley motor 37. It also shows the top elongated member 26 and the linear bearing guide 36 that is situated directly on top of it. One of the linear bearings 28 is shown as well. The rear end of the top elongated member 26 is attached to the mower with brackets (see FIG. 21). As shown in this figure, one pair of rollers 64 is configured to come into contact with the front of each vertical post 8, and another pair of rollers 65 is configured to come into contact with the back of each vertical post 8 (see also FIG. 20). The rollers 64, 65 allow the vertical posts 8 to move up and down. The first pair of rollers 64 are guide rollers, and the second pair of rollers 65 are centering rollers; in other words, the second pair of rollers is both larger and sturdier than the first pair of rollers because the rear side of the vertical posts 8 are subject to the most force during operation of the screed.

Figure 16:
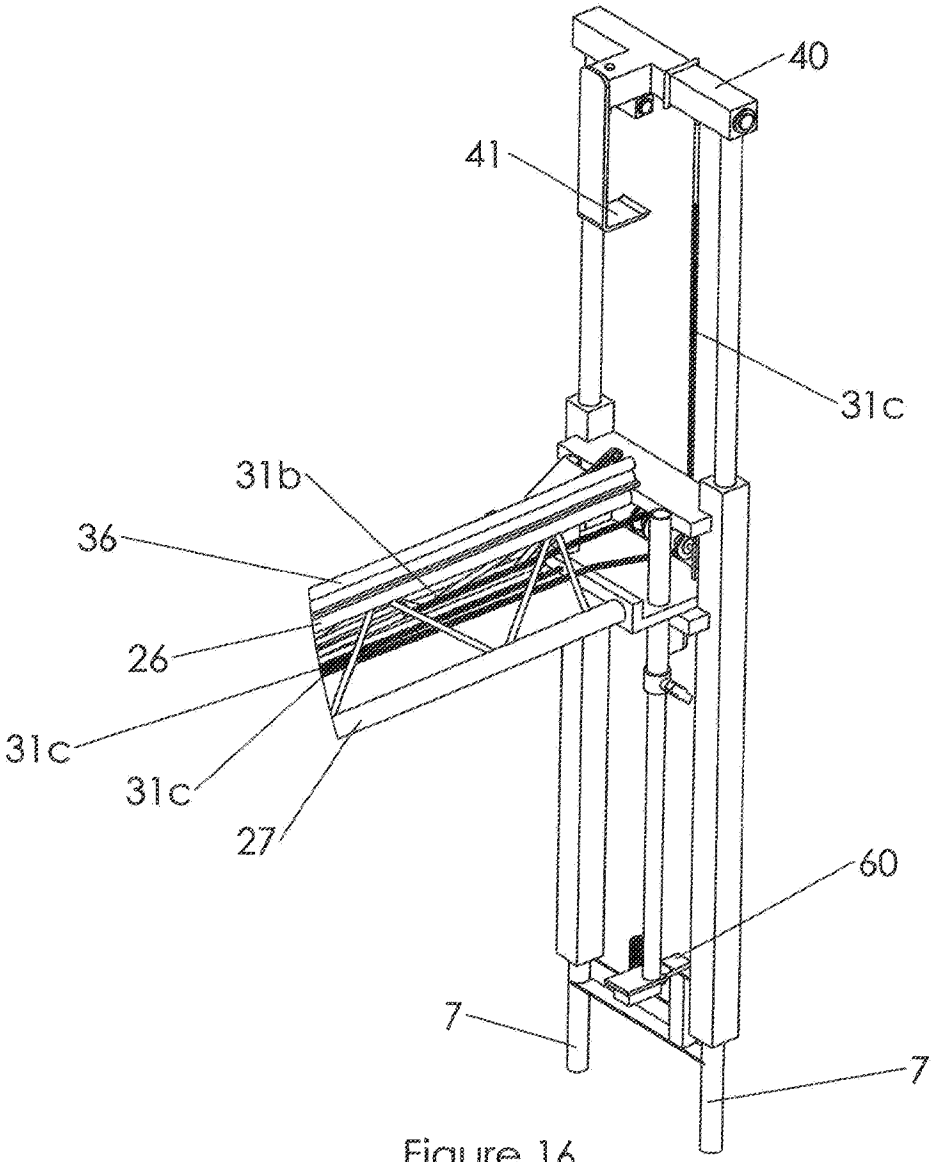
FIG. 16 is a first detail perspective view of the legs of the present invention shown with the legs in an "up" or retracted position.
Figure 17:
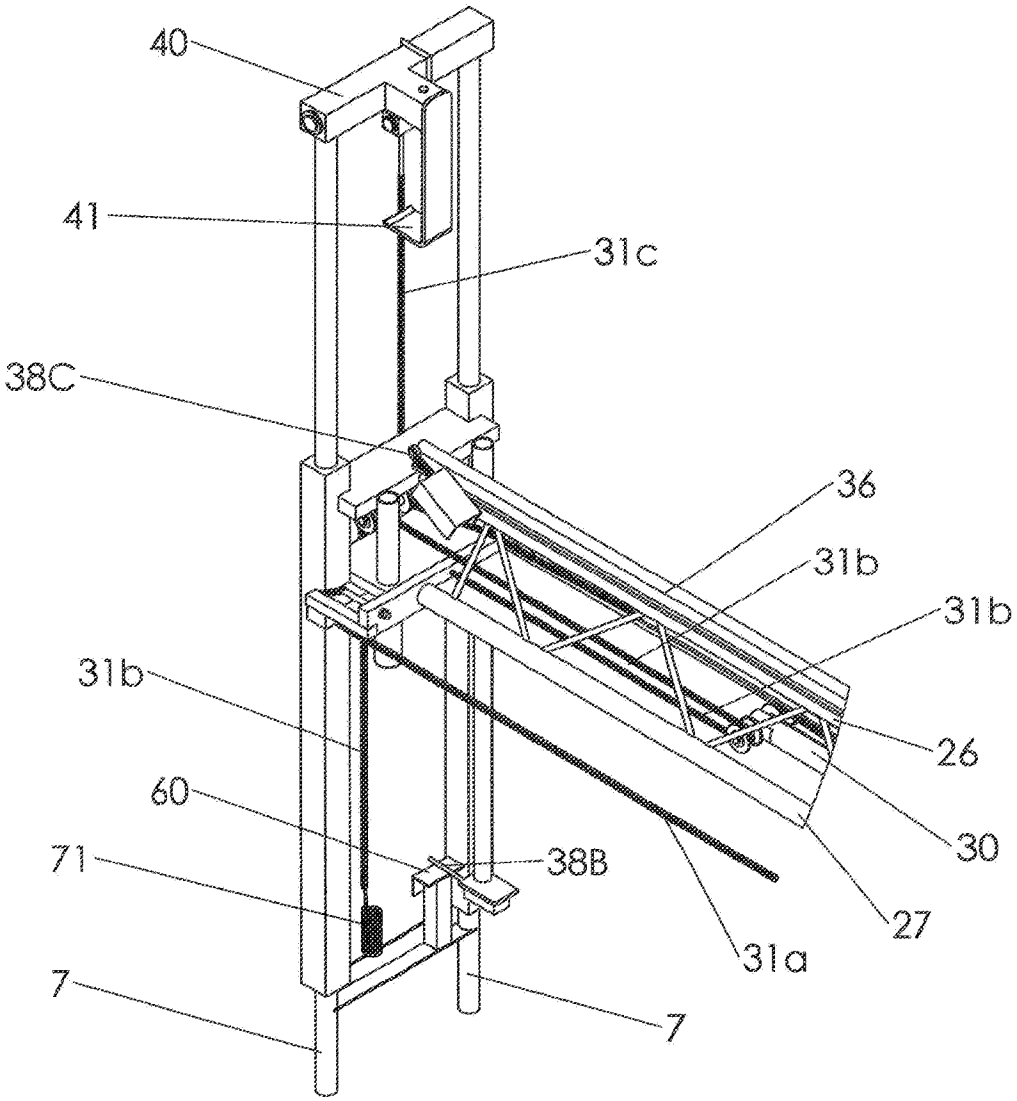
FIG. 17 is a second detail perspective view of the legs of the present invention shown with the legs in an "up" or retracted position.
Figure 18:
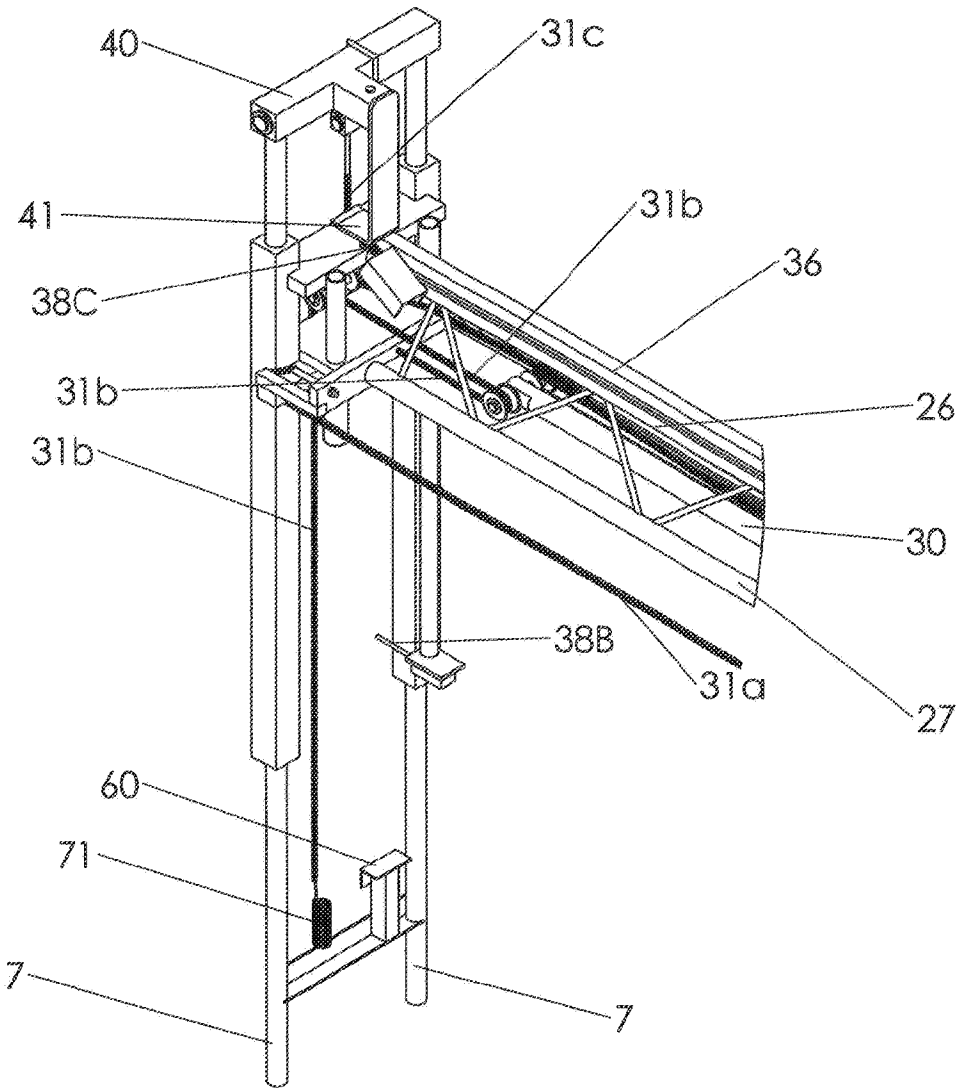
FIG. 18 is a first detail perspective view of the legs of the present invention shown with the legs in a "down" or extended position.
Figure 19:
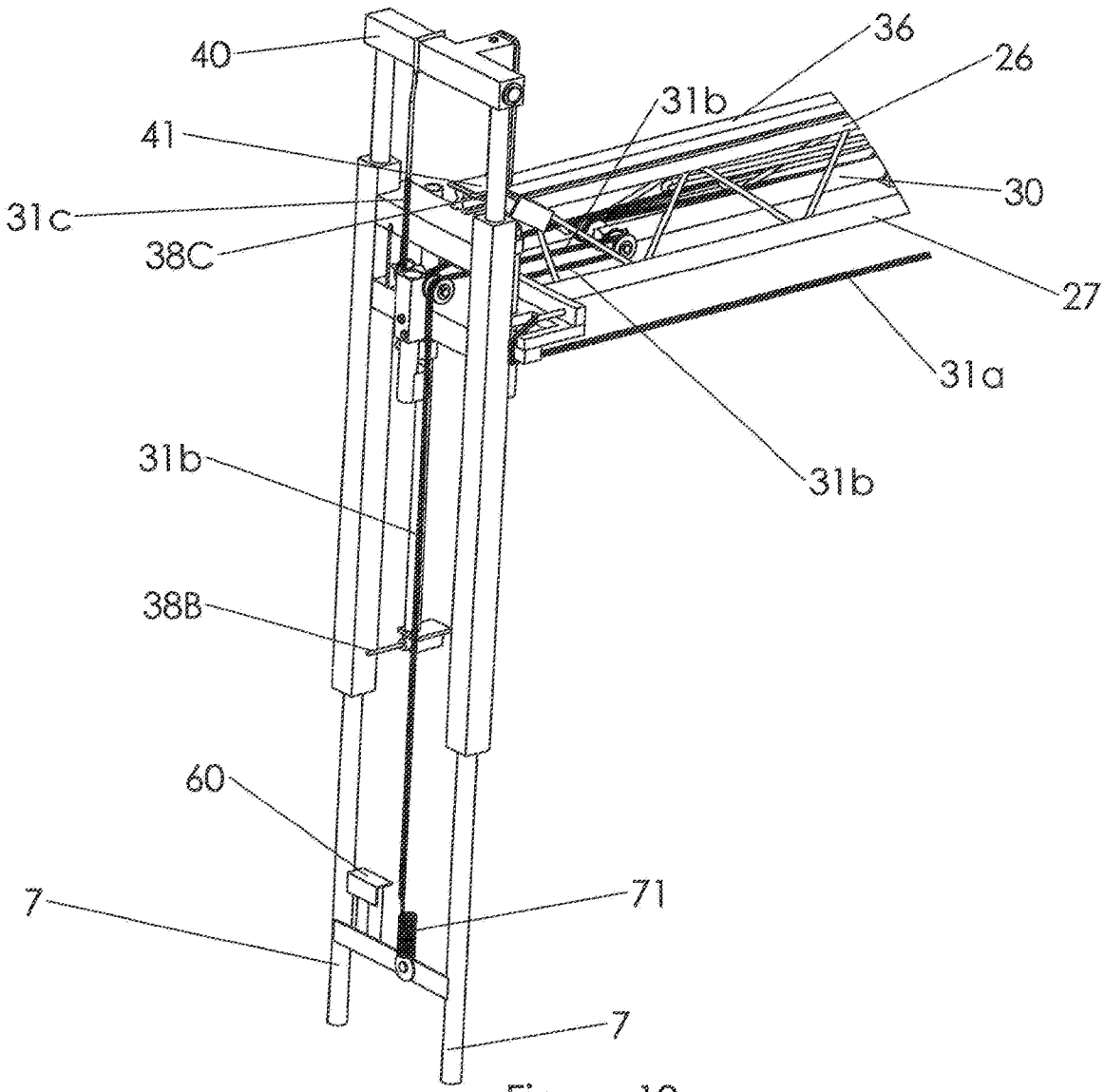
FIG. 19 is a second detail perspective view of the legs of the present invention shown with the legs in a "down" or extended position.

FIGS. 16-19 illustrate the mechanism by which the legs 7 are raised and lowered. The present invention incorporates three separate chains. The first chain 31*a* is shown in FIGS. 18 and 19. This is a stationary chain that is fixedly attached to the distal end of the truss (as shown in FIGS. 18 and 19) and to a bracket 39 on the front end of the mover 2 (see FIG. 21). This chain 31*a* passes through gears 54 on the outside of the trolley motor 37 (see FIG. 26), which "crawls" along the chain. This is what pulls the trolley 5 from one end of the truss 6 to the other. The second chain 31*b* is shown in FIGS. 17-19. This chain 31*b* is configured to raise the legs 7 when the linear actuator 30 is retracted. FIG. 17 shows the spring 71 that is configured to provide tension to the chain 31*b*.

In FIGS. 16 and 17, the linear actuator 30 is retracted; in FIGS. 18 and 19, it is not. The third chain 31*c* is configured to pull the legs 7 back down by pulling down on the top bar 40 of the legs 7 when the linear actuator 30 is extended (in the position shown in FIGS. 18 and 19). In this manner, the gap between the top bar 40 of the legs 7 and the truss 6 is closed. When this gap closes, a stop 41 hits a limit switch 38C (see FIG. 18), thereby causing the linear actuator 30 to stop extending itself and limiting upward travel of the legs 7. Referring to FIG. 17, when the legs 7 are raised, a limit switch 38B hits another stop 60, thereby preventing the legs from moving any further upward. In a preferred embodiment, one or both stops 41, 60 are configured to be removable and/or adjustable in length. Note that in FIG. 16, there appears to be a jog in the chain 31*c* in mid-air; this is because in a preferred embodiment, there is a tube that underlies the chain 31*c* to provide support to the chain. This tube has been omitted from the drawings for clarity.

Figure 20:
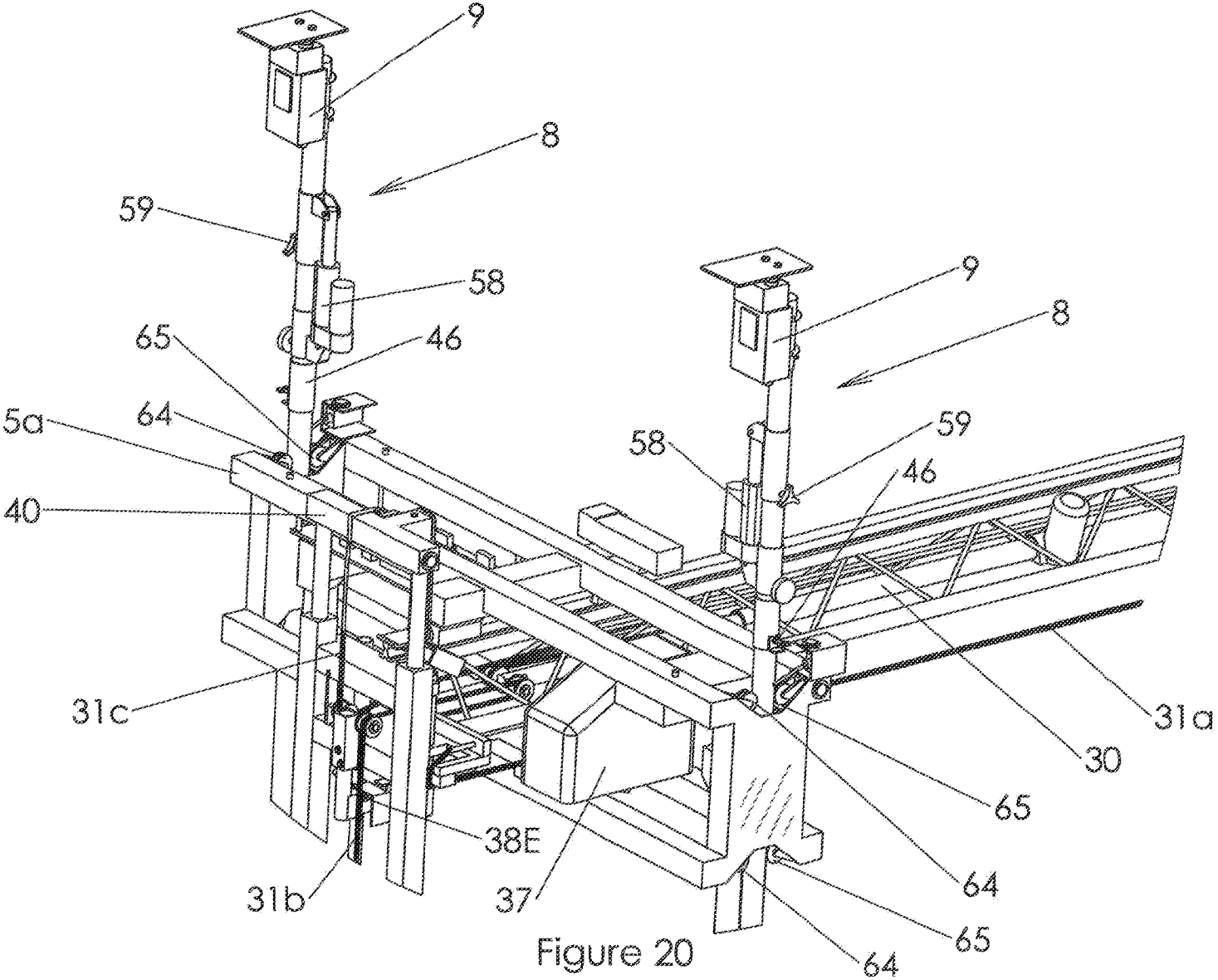
FIG. 20 is a detail perspective view of the front end of the truss with the legs fully extended and the trolley in an extended position prior to screeding.

FIG. 20 is a detail perspective view of the front end of the truss with the legs fully extended and the trolley in an extended position prior to screeding. In this figure, the trolley 5 has moved outward along the truss until a limit switch 38D on the front bottom end of the trolley hits a stop 49 that is located next to the legs 7 (see FIG. 26). Once activated, this switch 38D stops the trolley motor 37 and prevents the trolley 5 from moving further forward. At the same time, a limit switch 38E hits stop 72. When the operator is prepared to begin the screeding operation, he presses button C (see FIG. 30). The screed 4 lowers to acquire laser center on the receivers 9, which places the screed on the designated concrete grade. When the operator presses another button on the remote control unit 53, the screed 4 and trolley 5 begin to move along the truss 6 from the distal position toward the home position. The limit switch 38E moves clear of the stop 72, which starts the vibrator 23.

Figure 21:
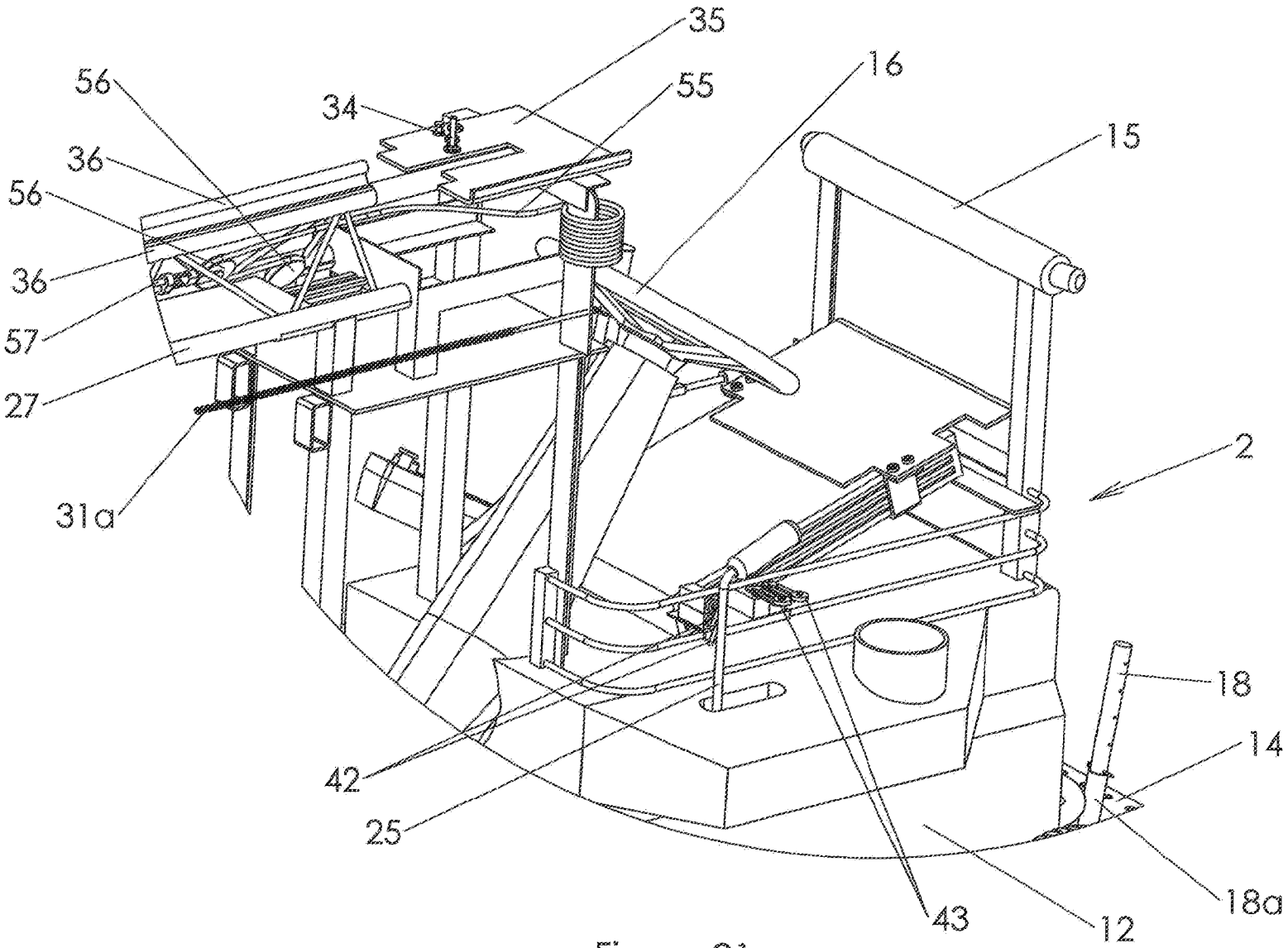
FIG. 21 is a detail perspective view of a first side of the mover showing two pairs of lever switches.
Figure 22:
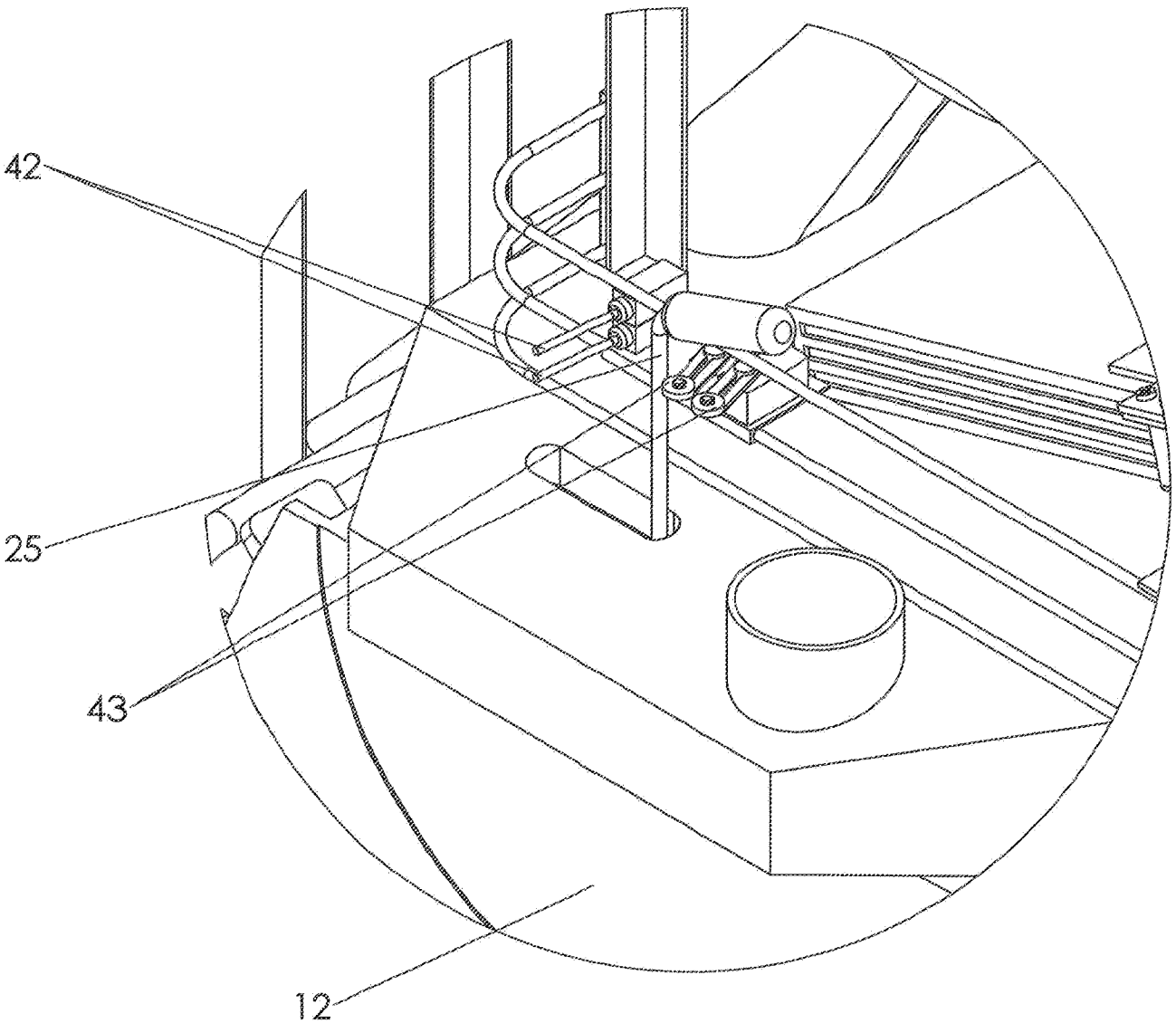
FIG. 22 is a detail view of the limit switches shown in FIG. 21.

FIGS. 21-26 illustrate the various limit switches incorporated into the present invention. In FIGS. 21-24 and 26, the trolley 5 is in the extended position (with the trolley adjacent to the legs), whereas in FIG. 25, the trolley 5 is in the home position. FIGS. 21 and 22 show two sets of limit switches. When the first set 42 of lever switches is activated by moving the brake lever 25 forward, the legs 7 are lowered (see FIG. 21). When the second set 43 of lever switches is activated by moving the brake lever 25 back, the legs 7 are raised (see FIG. 22).

Figure 23:
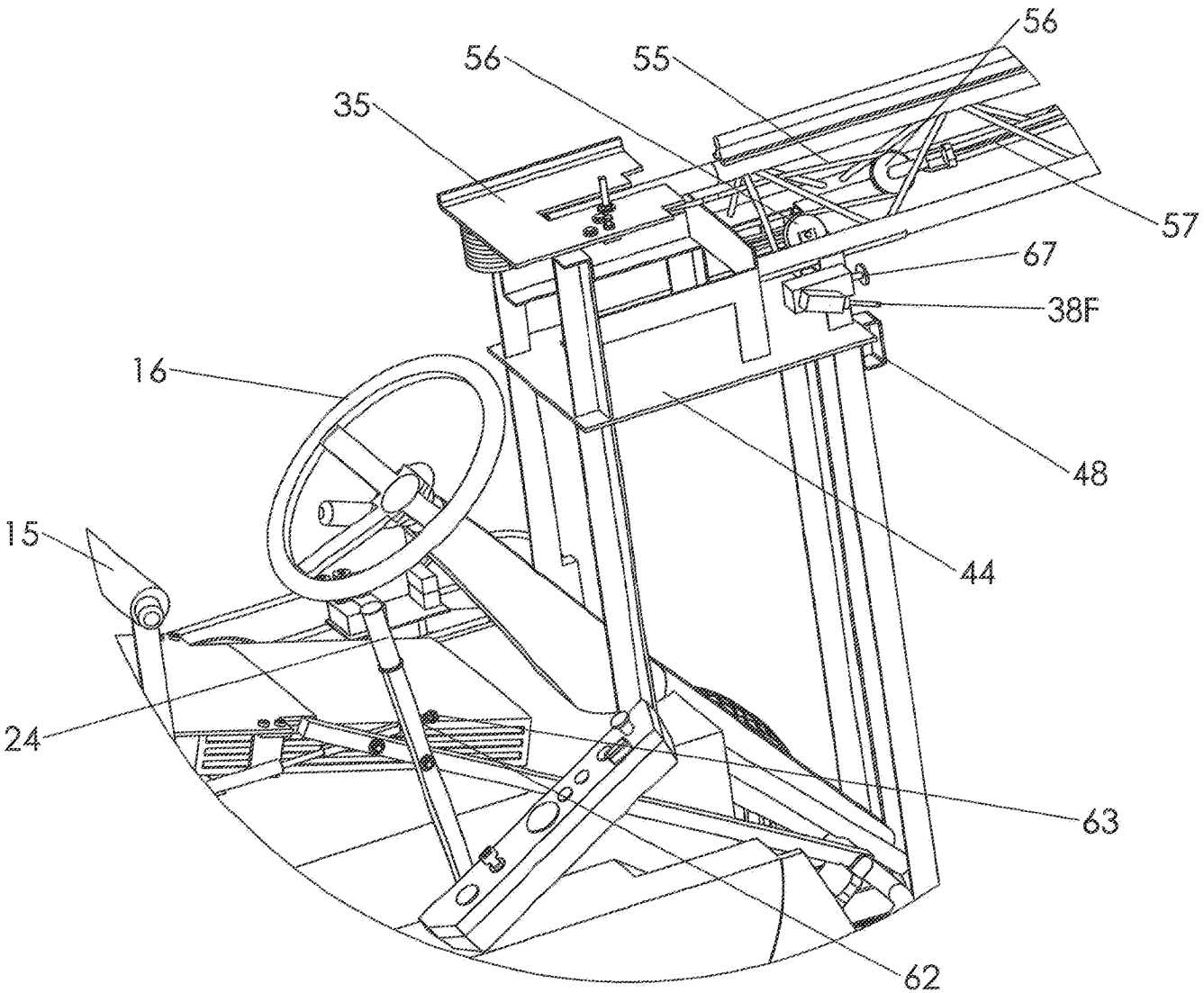
FIG. 23 is a detail perspective view of a second side of the mover showing two additional limit switches.
Figure 24:
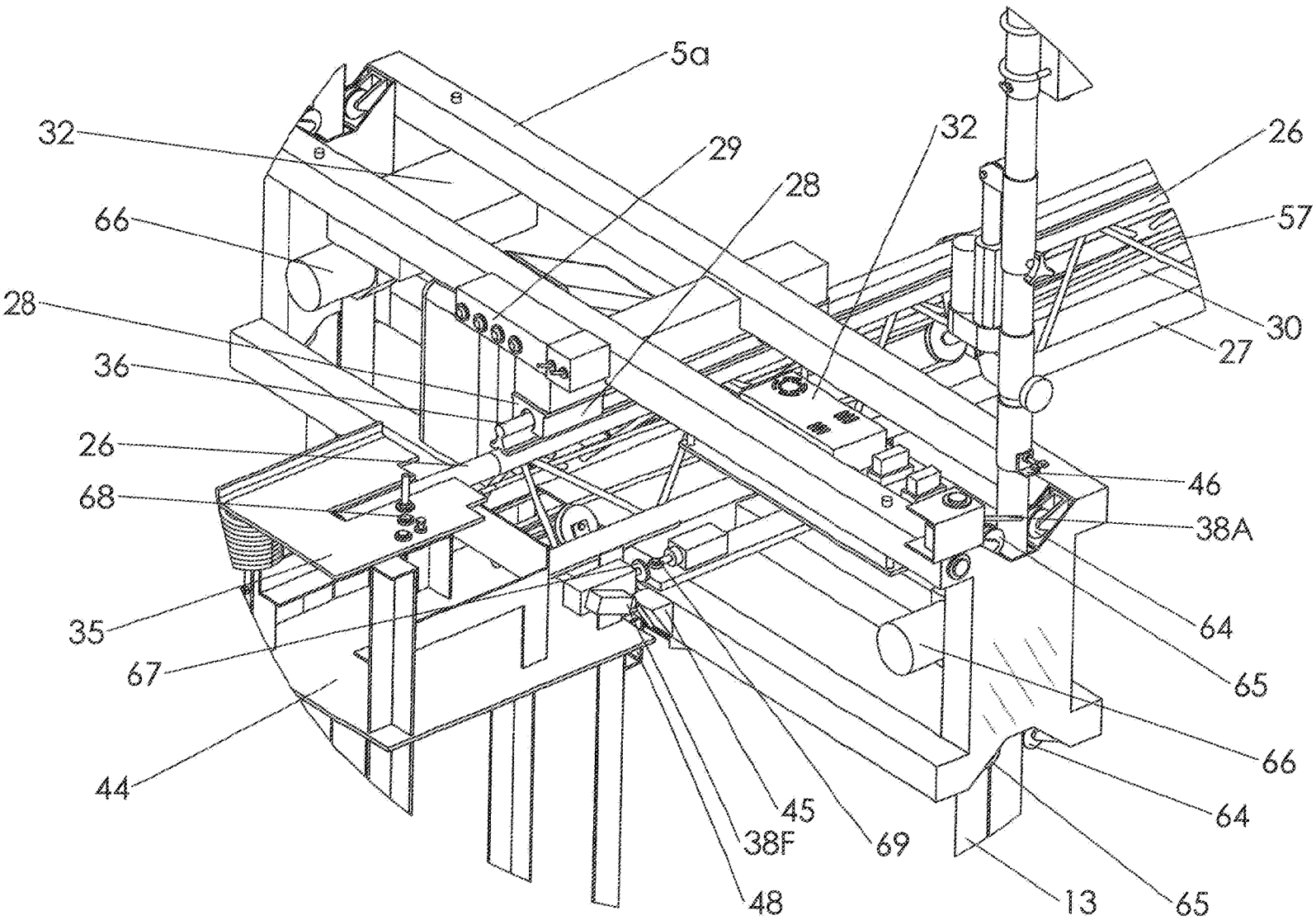
FIG. 24 is a detail perspective view of a second side of the mover with the two limit switches shown in FIG. 23 now engaged.

As shown in FIGS. 23 and 24, one limit switch 38 is preferably situated on a platform 44 that is situated on a front end of the mover 2 and configured to abut up against a protrusion 45 on the rear side of the trolley S when the trolley is in a home position. This limit switch 38A (see FIG.

24) limits the vertical pole 8 from traveling further downward. Another limit switch 38A (see FIG. 25) is situated on the top right rear end of the trolley 5 and configured to interact with a stop 46 on the vertical post 8. Both of these switches 38A operate in the same manner. When this limit switch 38A engages with this stop 46, the linear actuators 13 are stopped from moving the vertical posts 8 any further downward. Note that there is a stop 46 and a corresponding limit switch 38A on both vertical posts. A piston 67 that is activated by a button 68 is configured to trigger a plunger-style limit switch 69 (see FIG. 24), which is allowed when limit switch 38F is depressed by the trolley in home position, and which in turn sends the trolley 5 back out again.

Figure 25:
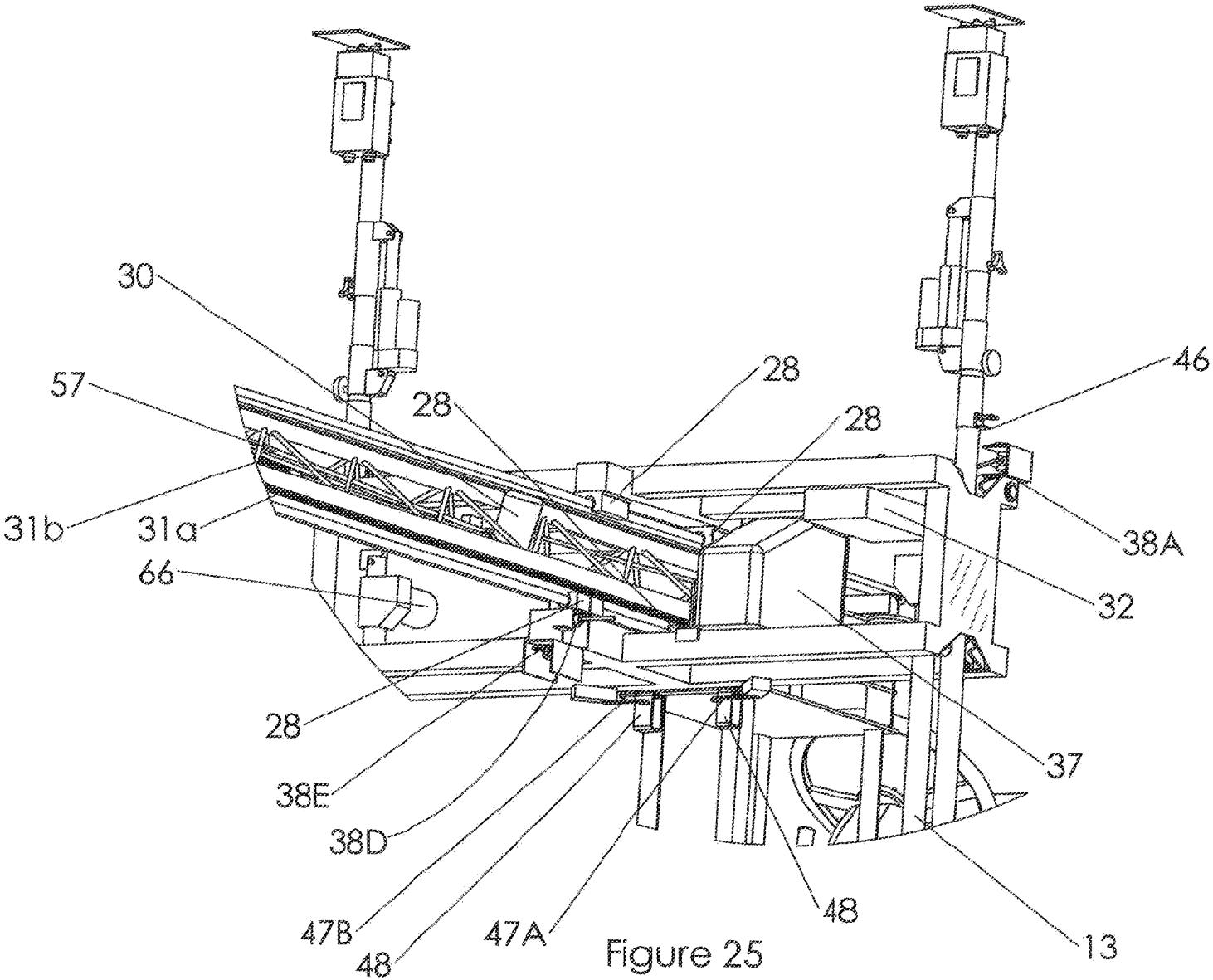
FIG. 25 is a detail perspective view of the trolly in the home position showing a limit switch on the underside of the truss.
Figure 26:
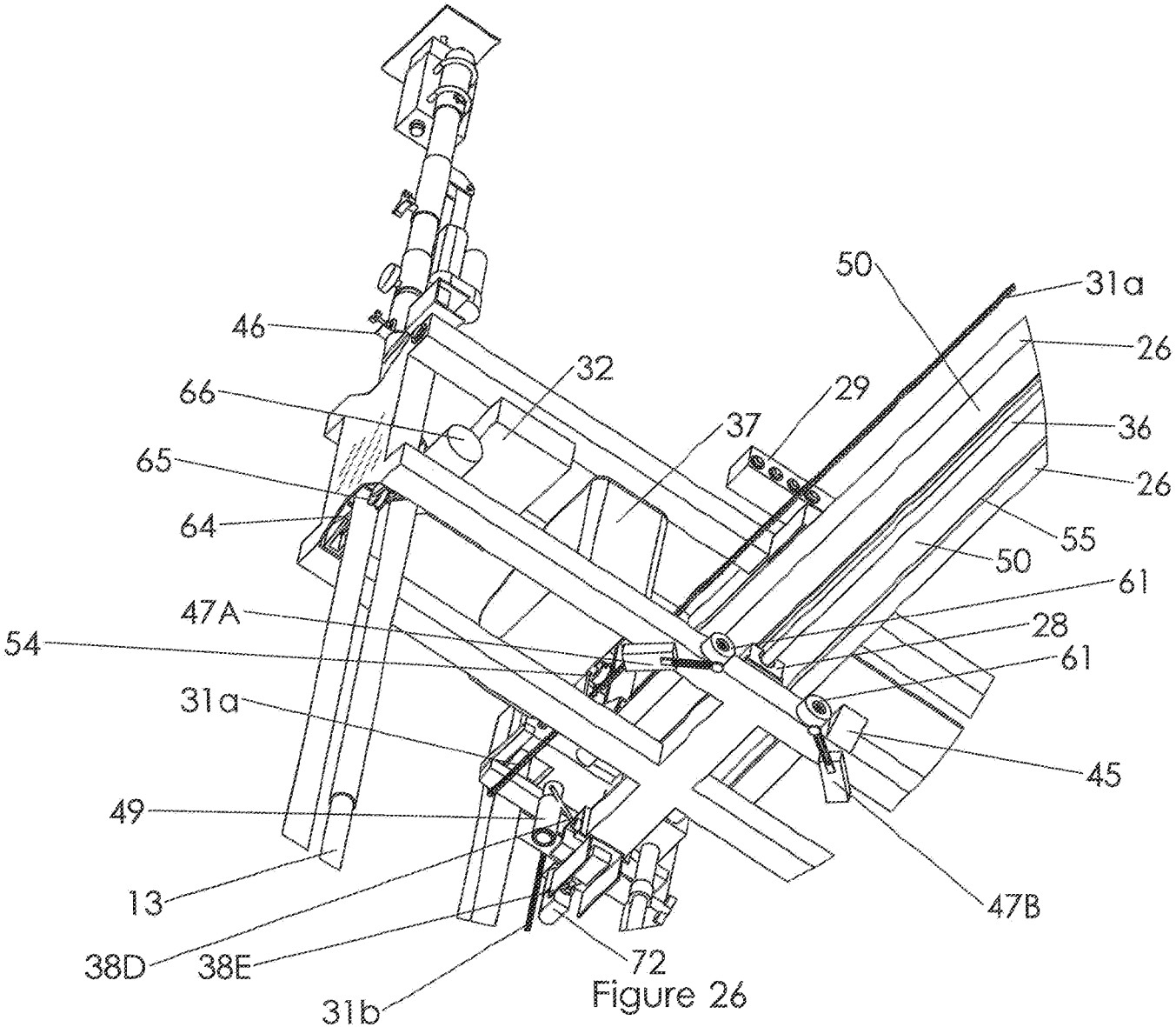
FIG. 26 is a detail bottom perspective view of the trolley in an extended position prior to screeding.

As shown in FIGS. 25 and 26, there is a third pair of lever switches 47A, 47B situated on the bottom of the trolley 5. Lever switch 47A functions to stop the trolley S from moving further backward toward the mover 2. Lever switch 47B stops the vibrator upon return of the trolley 5 to the home position. Another limit switch 38D situated on the bottom of the trolley 5, is configured to abut up against a stop 49 (see FIG. 26) that is mounted onto the legs 7, thereby stopping the trolley motor 37 and preventing the trolley from moving further forward. In this embodiment, a plate 50 is situated directly above the linear bearing guide 36 on the bottom of the truss 6. Bumpers 61 on the rear surface of the trolley S provide for a soft landing when the trolley returns to home position.

Figure 27:
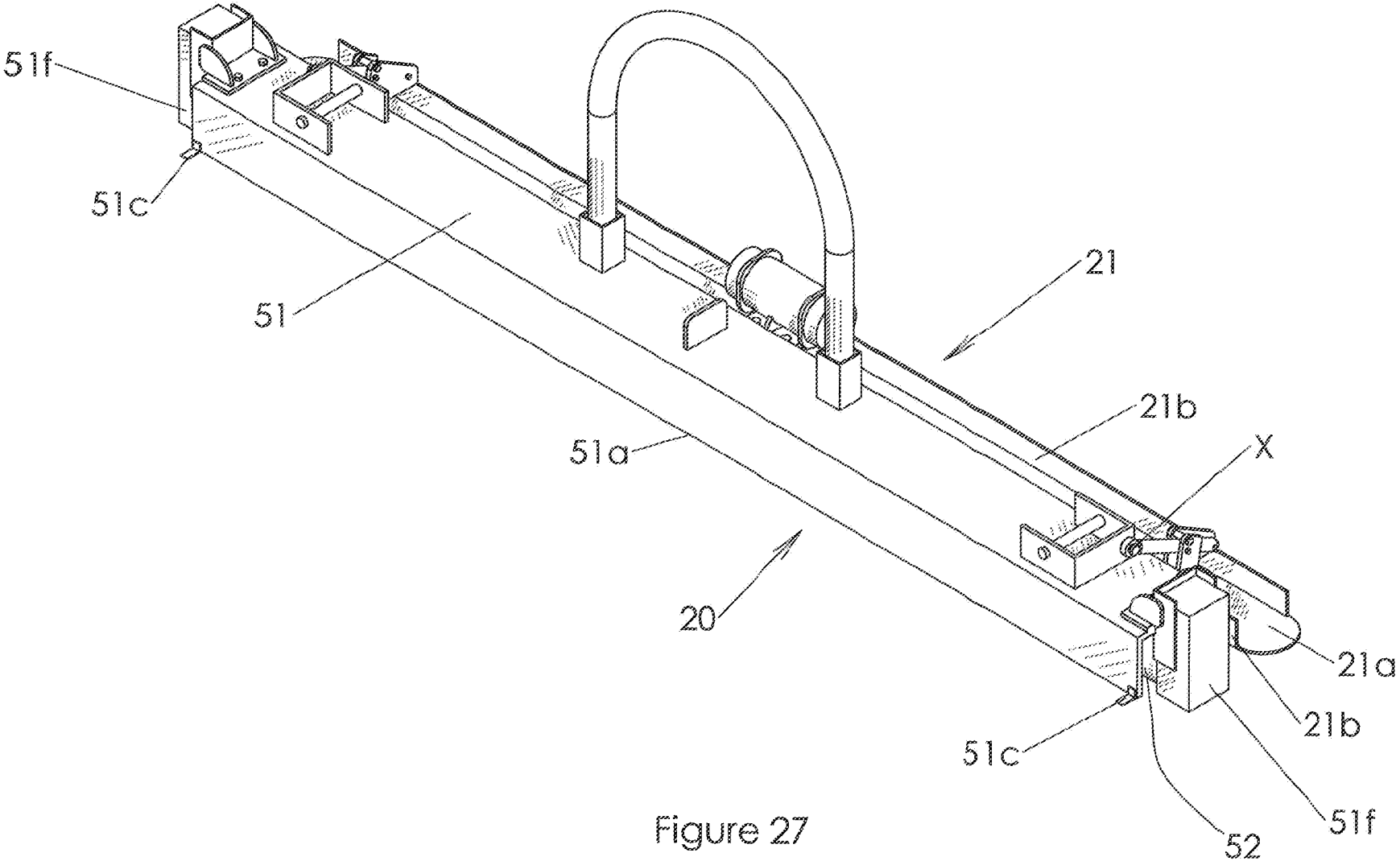
FIG. 27 is a top rear perspective view of the screed of the present invention.

FIG. 27 is a top rear perspective view of the screed of the present invention. As shown in this figure, the screed 4 is comprised of a U-shaped member 51 with two knife edges 51*a*, 51*b* that are configured to make contact with the ground surface when the screed is in operation. The two knife edges 51*a*, 51*b* are at the same level relative to the ground surface. Two ears 51*c* are situated on the far corners of the knife edge 51*a*; the purpose of these ears 51*c* is to facilitate the positioning of the vertical posts 8 prior to the alignment process that is described above in connection with FIG. 3. The pivoting member 21 comprises a flat bottom plate 21*a* that is configured to ride on top of the surface of the wet concrete and to further flatten the wet concrete surface (after the two knife edges 51*a*, 51*b* have scraped the wet concrete) as the pivoting member 21 vibrates. In addition, the pivoting member 21 preferably comprises two side walls 21*b* that extend the length of the pivoting member 21, with the bottom plate 21*a* disposed between them.

Figure 28:
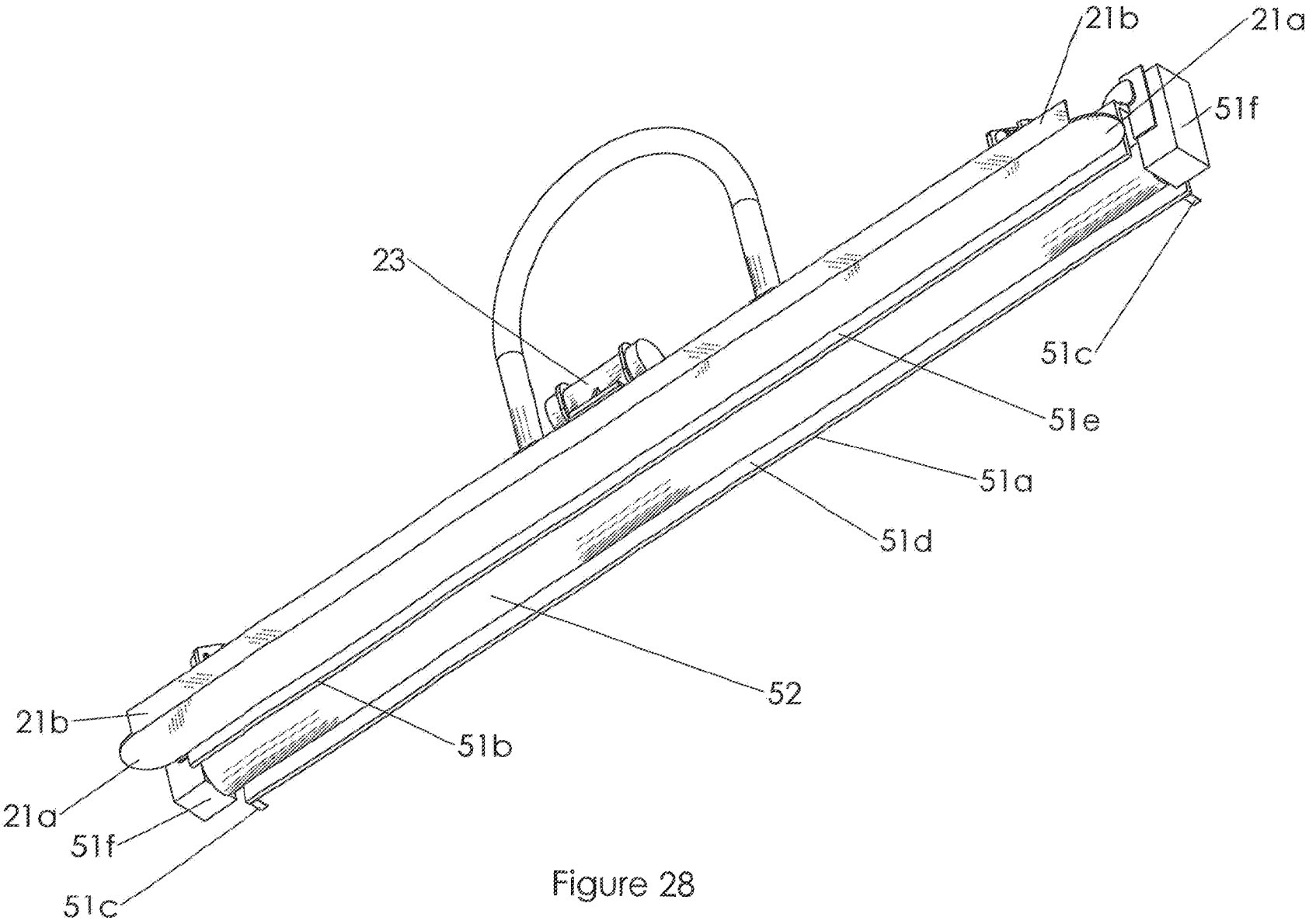
FIG. 28 is a bottom front perspective view of the screed of the present invention.

FIG. 28 is a bottom front perspective view of the screed of the present invention. As shown in this figure, a roller 52 is situated between the two side walls 51*d*, 51*e* of the U-shaped member 51 and rotates about a shaft (not shown). The ends of this shaft are contained within a housing 51*f* on either end of the U-shaped member 51. The roller 25 is configured to make contact with the wet concrete during the screeding operation, serving to flatten the wet concrete after the first knife edge 51*a* scrapes the wet concrete and before the second knife edge 51*b* scrapes the wet concrete.

Figure 29:
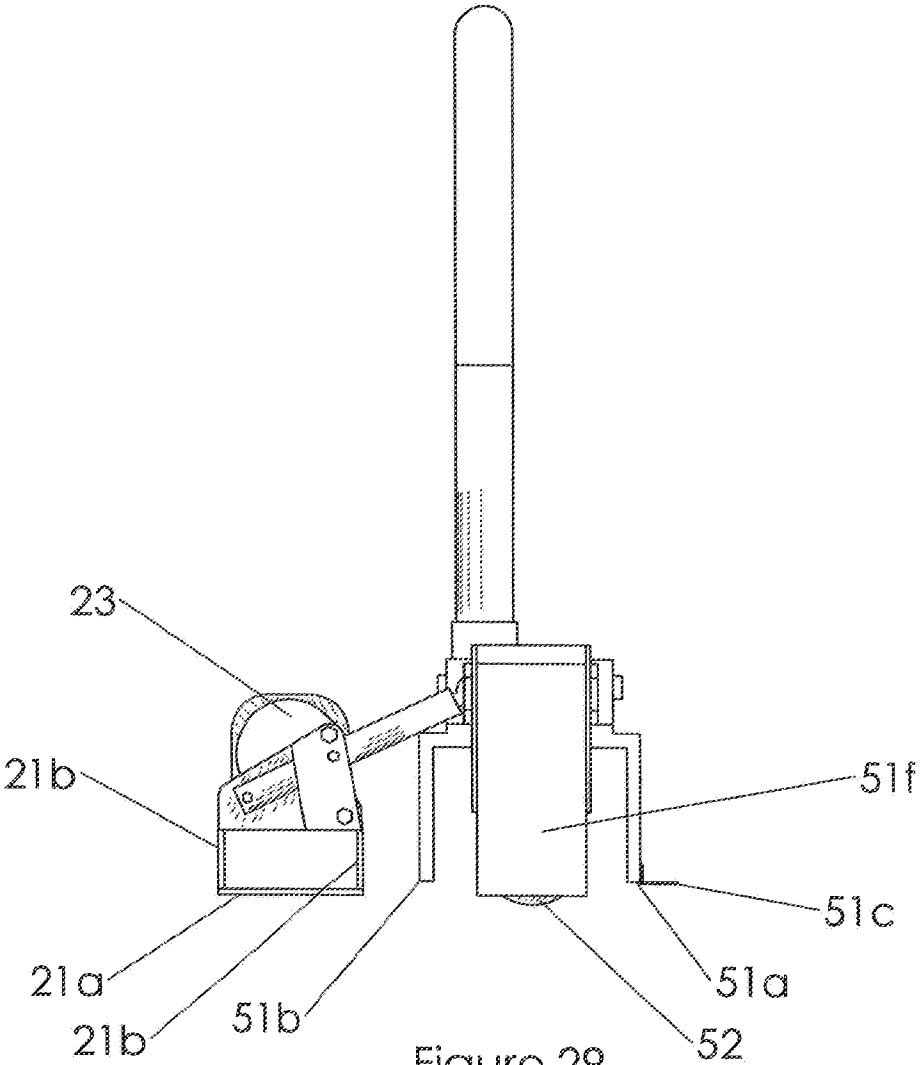
FIG. 29 is a side view of the screed of the present invention.

FIG. 29 is a side view of the screed of the present invention. This figure presents an alternate view of the various parts of the screed 4, as described in the preceding two paragraphs. Note that in a preferred embodiment, the bottom edge of the roller 52 is preferably slightly lower than the two knife edges 51*a*, 51*b*.

Figure 30:
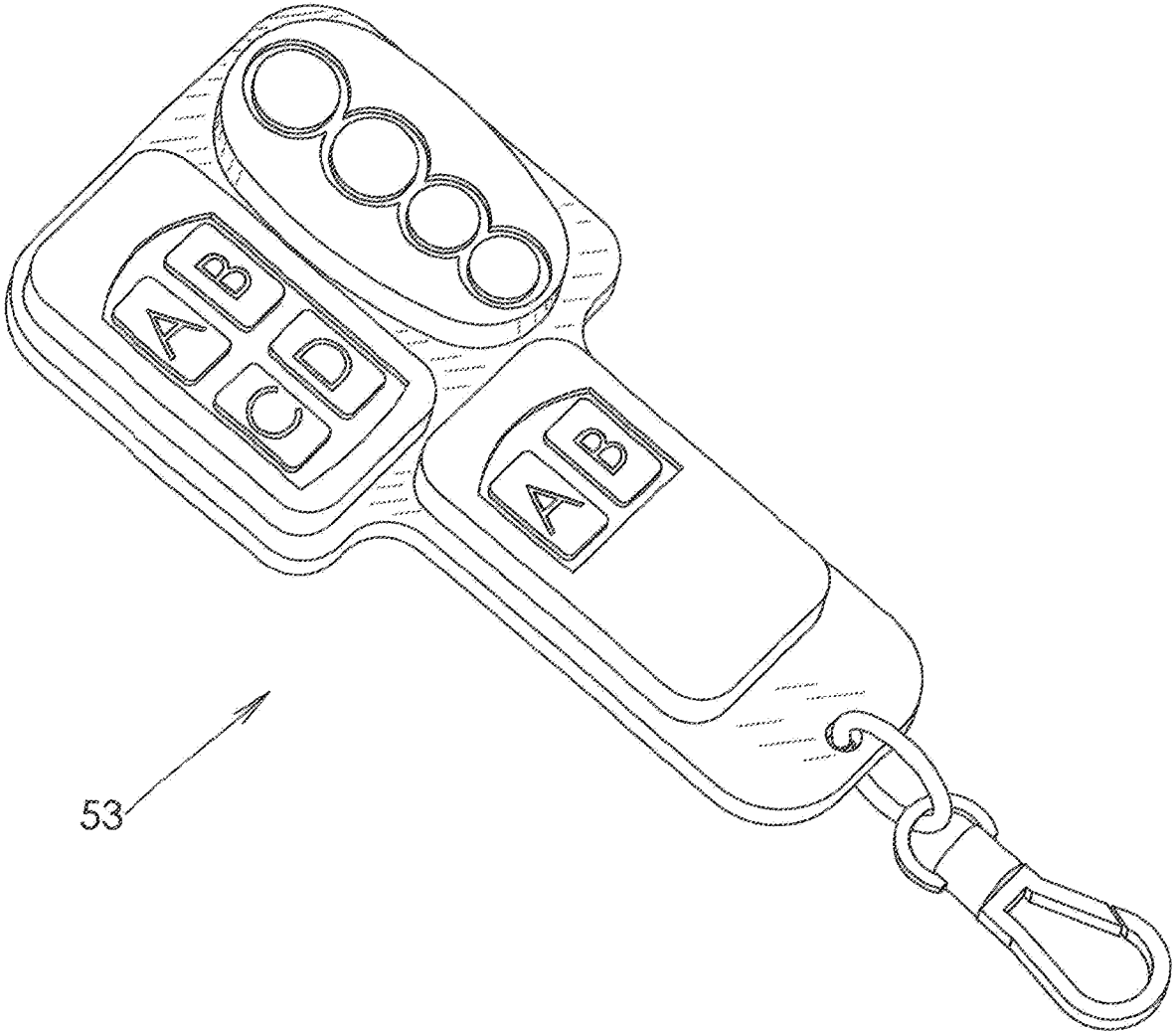
FIG. 30 is a perspective view of the remote control unit of the present invention.

FIG. 30 is a perspective view of the remote control unit of the present invention. The remote control unit 53 is configured to communicate with the laser 10 and receivers 9. Power from the mover 2 to the trolley 5 is supplied via a power cord 55 that runs underneath the truss 6 (see FIG. 26). Slack in the power cord 55 is taken up by a pulley system that is comprised of two pulleys 56 and a bungee cord 57. The bungee cord 57 is configured to pull any slack in the power cord 55 away from the mover 2 as the trolley 5 moves back into home position from the extended position.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A laser-controlled truss screed apparatus comprising:
(a) a laser;
(b) a mover;
(c) a truss assembly; and
(d) first and second receivers;
wherein the truss assembly comprises a screed, a trolley, a truss, legs, and first and second vertical posts;
wherein the first and second receivers are configured to receive a signal from the laser;
wherein the mover is disposed on a first end of the truss, and the legs are disposed on a second end of the truss;
wherein the first and second vertical posts, the trolley, and the screed are configured to form a single unit that travels back and forth along the truss;
wherein the first vertical post comprises a bottom end that is secured to a first end of the screed, and the second vertical post comprises a bottom end that is secured to a second end of the screed; and
wherein the legs are configured to raise and lower while maintaining a position of the truss relative to the wheels.

2. The laser-controlled truss screed apparatus of claim 1, wherein the mover comprises four wheels, a platform that is configured to support a person, a steering wheel that is configured to control the wheels, and a handlebar.

3. The laser-controlled truss screed apparatus of claim 1, wherein the truss passes from the legs through a center of the trolley and terminates above a front end of the mover.

4. The laser-controlled truss screed apparatus of claim 1, wherein the screed comprises a main body and a pivoting member;
wherein the pivoting member is pivotally attached to the main body; and
wherein both the pivoting member and the main body are oriented perpendicular to the truss and parallel to the trolley.

5. The laser-controlled truss screed apparatus of claim 1, wherein the main body is configured to be detached from the first and second vertical posts for transportation and cleaning.

6. The laser-controlled truss screed apparatus of claim 1, wherein the pivoting member comprises a vibrator that is configured to cause the pivoting member to vibrate during operation of the screed.

7. The laser-controlled truss screed apparatus of claim 1, wherein the truss is triangular in cross-section and comprises a top elongated member and two bottom elongated members that are configured to form a triangle shape when viewed from a front or rear end of the truss.

8. The laser-controlled truss screed apparatus of claim 1, wherein the truss comprises first and second linear bearing guides;
wherein the first linear bearing guide is situated on top of the top elongated member;

wherein the second linear bearing guide is situated between the two bottom elongated members; and wherein the trolley comprises a plurality of linear bearings that are coupled to and travel along the first and second linear bearing guides.

9. The laser-controlled truss screed apparatus of claim 1, further comprising a first pair of linear actuators that are configured to raise and lower the vertical posts.

10. The laser-controlled truss screed apparatus of claim 1, further comprising a second pair of linear actuators that are configured to raise and lower the screed without raising or lowering the first and second vertical posts.

11. The laser-controlled truss screed apparatus of claim 1, wherein the first vertical post passes through a first end of the trolley, and the second vertical post passes through a second end of the trolley;

wherein the first end of the trolley comprises a first pair of guide rollers that are configured to engage with a front surface of the first vertical post and a first pair of centering rollers that are configured to engage with a rear surface of the first vertical post; and wherein the second end of the trolley comprises a second pair of guide rollers that are configured to engage with a front surface of the second vertical post and a second pair of centering rollers that are configured to engage with a rear surface of the second vertical post.

12. The laser-controlled truss screed apparatus of claim 1, wherein the screed is comprised of a U-shaped member with first and second knife edges that run parallel to each other along a width of the screed;

wherein the first and second knife edges are configured to make contact with a ground surface when the screed is in operation; and wherein the pivoting member comprises a flat bottom plate that is configured to ride on top of and to flatten a wet concrete surface after it has been scraped by the first and second knife edges.

13. The laser-controlled truss screed apparatus of claim 12, wherein the U-shaped member further comprises a roller that is situated between the first and second knife edges and configured to make contact with the wet concrete surface after the first knife edges scrapes the wet concrete surface and before the second knife edges scrapes the wet concrete surface.

14. A truss screed apparatus comprising:

(a) a mover;

(b) a truss assembly; and (c) first and second receivers;

wherein the truss assembly comprises a screed, a trolley, a truss, legs, and first and second vertical posts;

wherein the first and second receivers are configured to receive a signal to activate a linear positioner motor to extend or retract the screed;

wherein the mover is disposed on a first end of the truss, and the legs are disposed on a second end of the truss;

wherein the first and second vertical posts, the trolley, and the screed are configured to form a single unit that travels back and forth along the truss;

wherein the first vertical post comprises a bottom end that is secured to a first end of the screed, and the second vertical post comprises a bottom end that is secured to a second end of the screed; and wherein the legs are configured to raise and lower while maintaining a position of the truss relative to the wheels.

* * * * *